US008037576B2

(12) United States Patent
Meichtry

(10) Patent No.: US 8,037,576 B2
(45) Date of Patent: Oct. 18, 2011

(54) OVERHEAD DOORS AND ASSOCIATED TRACK AND GUIDE ASSEMBLIES FOR USE WITH SAME

(75) Inventor: Michael M. Meichtry, Brookfield, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 529 days.

(21) Appl. No.: 12/191,140

(22) Filed: Aug. 13, 2008

(65) Prior Publication Data

US 2009/0044454 A1 Feb. 19, 2009

Related U.S. Application Data

(60) Provisional application No. 60/956,363, filed on Aug. 16, 2007.

(51) Int. Cl.
*E05D 15/06* (2006.01)

(52) U.S. Cl. ..... 16/87 R; 16/87.2; 16/87 B; 16/90; 16/94 R; 16/96 R

(58) Field of Classification Search ..... 16/87 R, 16/87.2, 90, 93 R, 94 R, 96 R, 87 B; 49/201, 49/207, 273.1, DIG. 8; 160/197–200
See application file for complete search history.

(56) References Cited

U.S. PATENT DOCUMENTS

| | | | | |
|---|---|---|---|---|
| 1,787,451 | A | | 1/1931 | Mohun et al. |
| 1,990,870 | A | | 2/1935 | Kelly |
| 2,064,470 | A | | 12/1936 | Heckman |
| 2,090,146 | A | | 8/1937 | Pixley |
| 2,124,969 | A | | 7/1938 | Bagley et al. |
| 2,686,926 | A | | 8/1954 | Schacht, Jr. et al. |
| 2,839,135 | A | | 6/1958 | Anderson |
| 2,929,115 | A | * | 3/1960 | Beckstrom ..... 49/411 |
| 3,140,508 | A | | 7/1964 | Switzgable |
| 3,188,698 | A | | 6/1965 | Zoll et al. |
| 3,336,968 | A | | 8/1967 | Curtis |

(Continued)

FOREIGN PATENT DOCUMENTS

WO WO-2008/045037 4/2008

OTHER PUBLICATIONS

Material Handling Engineering, Mar. 1995, "A Door Built to Take the Punches", p. 19.

(Continued)

*Primary Examiner* — Victor Batson
*Assistant Examiner* — Roberta Delisle

(57) ABSTRACT

Overhead door assemblies having both interlocking and releasable guide assemblies, and multi-piece guide track assemblies for use with same are disclosed herein. An overhead door track configured in accordance with one embodiment of the invention includes a first side portion formed from a first piece of material and a second side portion formed from a second piece of material. The first side portion has a first guide surface and a first retention surface. The second side portion has a second guide surface and a second retention surface. In one aspect of this embodiment, the first side portion is joined to the second side portion to define an open channel or gap region therebetween. The first and second guide surfaces extend from the gap region toward a first direction, and the first and second retention surfaces diverge from the gap region toward a second direction, opposite to the first direction. The first and second retention surfaces can be configured to movably retain a door guide member.

26 Claims, 13 Drawing Sheets

U.S. PATENT DOCUMENTS 3,345,677 A * 10/1967 Milette ..... 16/90
3,484,812 A 12/1969 Holland
3,552,474 A 1/1971 Finnegan
3,693,693 A 9/1972 Court
3,928,889 A 12/1975 Wartian
3,934,635 A 1/1976 Kin
4,016,920 A 4/1977 Shepard
4,080,757 A 3/1978 Westerman
4,120,072 A 10/1978 Hormann et al.
4,149,295 A 4/1979 Owen
4,155,268 A 5/1979 Lee et al.
4,205,713 A 6/1980 Galbreath
4,352,585 A 10/1982 Spalding
4,379,479 A 4/1983 Whiting
4,478,268 A 10/1984 Palmer et al.
4,572,268 A 2/1986 Wentzel
4,601,320 A 7/1986 Taylor et al.
4,676,293 A 6/1987 Hanssen
4,800,618 A 1/1989 Putz
4,836,589 A 6/1989 Mohr
4,846,245 A 7/1989 Pagliaro et al.
4,894,888 A 1/1990 Bassouls
4,934,835 A 6/1990 Albert et al.
5,036,899 A 8/1991 Mullet
5,058,651 A * 10/1991 Ashley et al. ..... 160/271
5,131,450 A 7/1992 Lichy
5,141,043 A 8/1992 Kraeutler et al.
5,163,495 A 11/1992 Lichy
5,219,015 A 6/1993 Kraeutler et al.
5,222,541 A 6/1993 Hornberger
5,240,216 A 8/1993 Lin et al.
5,271,448 A 12/1993 Delgado
5,291,686 A 3/1994 Sears et al.
5,299,617 A 4/1994 Hying et al.
5,307,855 A 5/1994 Martensson, IV
5,351,742 A 10/1994 Lichy
5,353,473 A 10/1994 Sherick
5,353,859 A 10/1994 Oltahfer et al.
5,365,993 A 11/1994 Jella
5,367,825 A 11/1994 Doring et al.
5,368,084 A 11/1994 Hying et al.
5,404,927 A 4/1995 Bailey
5,408,724 A 4/1995 Mullet et al.
5,409,051 A 4/1995 Mullet et al.
5,445,207 A 8/1995 Romanelli et al.
5,447,377 A 9/1995 Baumgartner et al.
5,477,902 A * 12/1995 Kraeutler ..... 160/84.06
5,522,446 A 6/1996 Mullet et al.
5,533,561 A 7/1996 Forehand, IV
5,535,805 A 7/1996 Kellogg et al.
5,562,141 A 10/1996 Mullet et al.
5,566,740 A 10/1996 Mullet et al.
5,568,672 A 10/1996 Mullet et al.
5,584,333 A 12/1996 Torchetti et al.
5,601,133 A 2/1997 Krupke et al.
5,620,039 A 4/1997 Delgado et al.
5,638,883 A 6/1997 Schulte
5,659,926 A 8/1997 Dietrich
5,718,533 A 2/1998 Mullet et al.
5,720,332 A 2/1998 Nachreiner
5,727,614 A 3/1998 Lichy
5,737,802 A 4/1998 Jella
5,743,317 A 4/1998 Beringer et al.
5,765,622 A 6/1998 Lichy
5,829,504 A 11/1998 Ekstrand et al.
5,887,385 A 3/1999 Horner et al.
5,927,368 A 7/1999 Rohrer et al.
5,927,862 A 7/1999 Debnam et al.
5,944,086 A 8/1999 Gruben et al.
5,946,869 A 9/1999 Zinbarg
5,954,111 A 9/1999 Ochoa
5,957,187 A 9/1999 Gruben et al.
5,992,497 A 11/1999 Jaehnen et al.
6,035,918 A * 3/2000 Kraeutler ..... 160/84.06
6,039,106 A 3/2000 Gontarski et al.
6,041,844 A 3/2000 Kellogg et al.
6,047,761 A 4/2000 Jaehnen et al.
6,068,040 A 5/2000 Magro et al.
6,076,590 A 6/2000 Ford et al.
6,082,430 A 7/2000 Mock
6,089,304 A 7/2000 Mullet et al.
6,089,305 A 7/2000 Gruben et al.
6,094,779 A 8/2000 Young
6,095,229 A 8/2000 Kellogg et al.
6,112,464 A 9/2000 Grisham et al.
6,112,799 A 9/2000 Mullet et al.
6,119,307 A 9/2000 Weishar et al.
6,125,506 A 10/2000 Martin
6,148,897 A 11/2000 Horner et al.
6,185,783 B1 2/2001 Carpinella
6,227,281 B1 5/2001 Martin
6,250,360 B1 6/2001 Ochoa
6,263,948 B1 7/2001 Whitley
6,273,175 B1 8/2001 Kellogg et al.
6,315,027 B1 11/2001 Lichy
6,321,822 B1 11/2001 Horner et al.
6,434,886 B1 8/2002 Johnson et al.
6,463,988 B1 10/2002 Mullet et al.
6,481,487 B2 11/2002 Simon et al.
6,527,035 B2 3/2003 Hoofard et al.
6,536,077 B1 3/2003 Espey
6,540,003 B1 4/2003 Martin
6,554,047 B1 4/2003 Mondragon et al.
6,574,832 B1 6/2003 Boerger et al.
6,588,482 B2 7/2003 Wright
6,598,648 B1 7/2003 Schulte
6,612,357 B1 9/2003 Beringer et al.
6,615,898 B2 9/2003 Schulte
6,640,496 B2 11/2003 Mullet
6,640,872 B1 11/2003 Mullet
6,644,378 B2 11/2003 Mitchell
6,655,442 B2 12/2003 Snyder
6,659,158 B2 12/2003 Laugenbach et al.
6,698,490 B2 3/2004 Hoerner et al.
6,715,236 B2 4/2004 Mullet
6,715,531 B2 4/2004 Simon et al.
6,729,380 B2 5/2004 Whitley et al.
6,739,372 B2 5/2004 Mullet et al.
6,745,814 B2 6/2004 Hoofard et al.
6,792,998 B2 9/2004 David
6,840,300 B2 1/2005 Lewis, Jr.
6,843,300 B2 1/2005 Mullet et al.
6,918,157 B2 7/2005 Koike et al.
6,951,237 B2 10/2005 Mullet
6,964,289 B2 11/2005 Schulte
7,011,347 B2 3/2006 Finardi et al.
7,036,548 B2 5/2006 Johnston et al.
7,055,571 B2 6/2006 Johnston et al.
7,089,990 B2 8/2006 Hormann et al.
7,114,291 B2 10/2006 David
7,114,753 B2 10/2006 Nodorft
7,117,916 B2 10/2006 Johnston et al.
7,128,123 B2 10/2006 Mullet et al.
7,721,387 B1 * 5/2010 Mullet et al. ..... 16/96 R
2009/0044453 A1 2/2009 Meichtry
2009/0044917 A1 2/2009 Meichtry

OTHER PUBLICATIONS

Non-Final Office Action; U.S. Appl. No. 12/191,118; Mailing Date: Mar. 5, 2010, 31 pages.
Non-Final Office Action; U.S. Appl. No. 12/191,146; Mailing Date: Aug. 19, 2010, 17 pages.
"MpactDoor," Aaron-Bradley Company, 1 page [date unknown].
"MpactDoor—Panel Features and General Specifications," Aaron-Bradley Company Inc., 1 page, published 2008.

* cited by examiner

OVERHEAD DOORS AND ASSOCIATED TRACK AND GUIDE ASSEMBLIES FOR USE WITH SAME

CROSS-REFERENCE TO RELATED APPLICATIONS

The present application claims priority to U.S. Provisional Application No. 60/956,363, filed Aug. 16, 2007, the disclosure of which is incorporated herein by reference in its entirety. The disclosures of the following patent applications are also incorporated herein by reference in their entireties: U.S. Provisional Application Ser. No. 60/956,355, filed Aug. 16, 2007; U.S. Provisional Application Ser. No. 60/956,368, filed Aug. 16, 2007; U.S. application Ser. No. 12/191,118, entitled "OVERHEAD DOORS AND ASSOCIATED TRACK AND GUIDE ASSEMBLIES FOR USE WITH SAME", filed concurrently herewith; and U.S. application Ser. No. 12/191,146, entitled "OVERHEAD DOORS AND ASSOCIATED TRACK, GUIDE, AND BRACKET ASSEMBLIES FOR USE WITH SAME", filed concurrently herewith.

TECHNICAL FIELD

The following disclosure relates generally to overhead doors and, more particularly, to overhead door tracks and associated guide assemblies.

BACKGROUND

Overhead doors have been used on loading docks and in various other warehouse and factory settings for many years. Conventional overhead doors are of the sectional type, and typically include four or more rectangular panels hinged together along the upper and lower edges. Each of the door panels carries two guide assemblies near the upper hinge line, and the bottom door panel usually carries two additional guide assemblies near the bottom edge. Each of the guide assemblies typically includes a plunger or roller device that extends outwardly from the door panel and is movably received in a channel section of an adjacent door track. The door tracks extend along the left and right sides of the door, and guide the door as it moves upwardly into the overhead or "open" position.

Conventional overhead doors are susceptible to damage when used in factories, warehouses, and other commercial and industrial settings. Occasionally, for example, a forklift operator may inadvertently run into the door, as can happen when the door is in a partially open position. This can damage the door and/or the door tracks, making further use of the door difficult or impossible without time-consuming repairs. One way to overcome this problem is to equip the door with spring-loaded guide assemblies that retract and release from the tracks when struck with sufficient force in one or more directions, as disclosed in, for example, U.S. Pat. No. 5,535,805 to Kellog, et al., U.S. Pat. No. 5,927,368 to Rohrer, et al., U.S. Pat. No. 6,041,844 to Kellog, et al., U.S. Pat. No. 6,095,229 to Kellog, et al., U.S. Pat. No. 6,119,307 to Weishar, et al., and U.S. Pat. No. 6,273,175 to Kellog, et al. (All of the foregoing patents are incorporated into the present disclosure in their entireties by reference).

Although configuring the door to release in one or both directions may avoid damage to the door when struck, this approach can present additional problems. For example, under certain conditions the entire door could be knocked out of the tracks, and reinstalling an entire door can be a difficult and time-consuming task. Furthermore, one or more spreader bars may be necessary to help hold the overhead door tracks in position.

SUMMARY

The following summary is provided for the benefit of the reader only, and is not intended to limit the invention as set forth by the claims in any way.

The present disclosure is directed generally to overhead door track and guide assemblies. An overhead door track configured in accordance with one aspect of the invention includes a first side portion formed from a first piece of material, and a second side portion formed from a second piece of material. The first side portion has a first guide surface and a first retention surface. Similarly, the second side portion has a second guide surface and a second retention surface. The first side portion is joined to the second side portion to define a gap region therebetween. In this aspect of the invention, the first and second guide surfaces diverge from the gap region toward a first direction, and the first and second retention surfaces diverge from the gap region toward a second direction, opposite the first direction. In one embodiment, the first side portion further includes a first flange, and the second side portion further includes a second flange that overlaps the first flange. In this embodiment, the track further includes a plurality of clinched connections or other fasteners extending through the first and second flanges. In another embodiment, the gap region between the first and second side portions is configured to removably receive an overhead door guide member.

An overhead door track assembly configured in accordance with another aspect of the invention includes a track and a track bracket. The track includes a first side portion having a first guide surface, and a second side portion having a second guide surface spaced apart from the first guide surface. The track bracket includes a first fitting having a first edge region configured to receive the first side portion of the track, and a second fitting having a second edge region configured to receive the second side portion of the track. In one embodiment, at least a first portion of the first fitting overlaps a second portion of the second fitting. In this embodiment, the track bracket further includes one or more clinched connections or other fasteners extending through the overlapping portions of the first and second fittings. The first fitting can also include a mounting flange configured to securely attach the track bracket to a building structure.

DETAILED DESCRIPTION

The following disclosure describes various embodiments of overhead door tracks and associated guide assemblies. In one embodiment, for example, an overhead door track is formed by joining two halves of a track section together along a longitudinal joint. In this embodiment, the door track can be configured to provide single knock-out (i.e., door release in a single direction), double knock-out (i.e., door release in two directions), and no-knock-out capabilities at different locations along the track to satisfy different functional requirements. Certain details are set forth in the following description and in FIGS. 1-14 to provide a thorough understanding of various embodiments of the invention. Other details describing well-known structures and systems often associated with overhead doors, overhead door tracks, and overhead door guide assemblies, have not been set forth in the following disclosure to avoid unnecessarily obscuring the description of the various embodiments of the invention.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar elements. To facilitate the discussion of any particular element, the most significant digit or digits of any reference number refer to the Figure in which that element is first introduced. For example, element 110 is first introduced and discussed with reference to FIG. 1.

Figure 1:
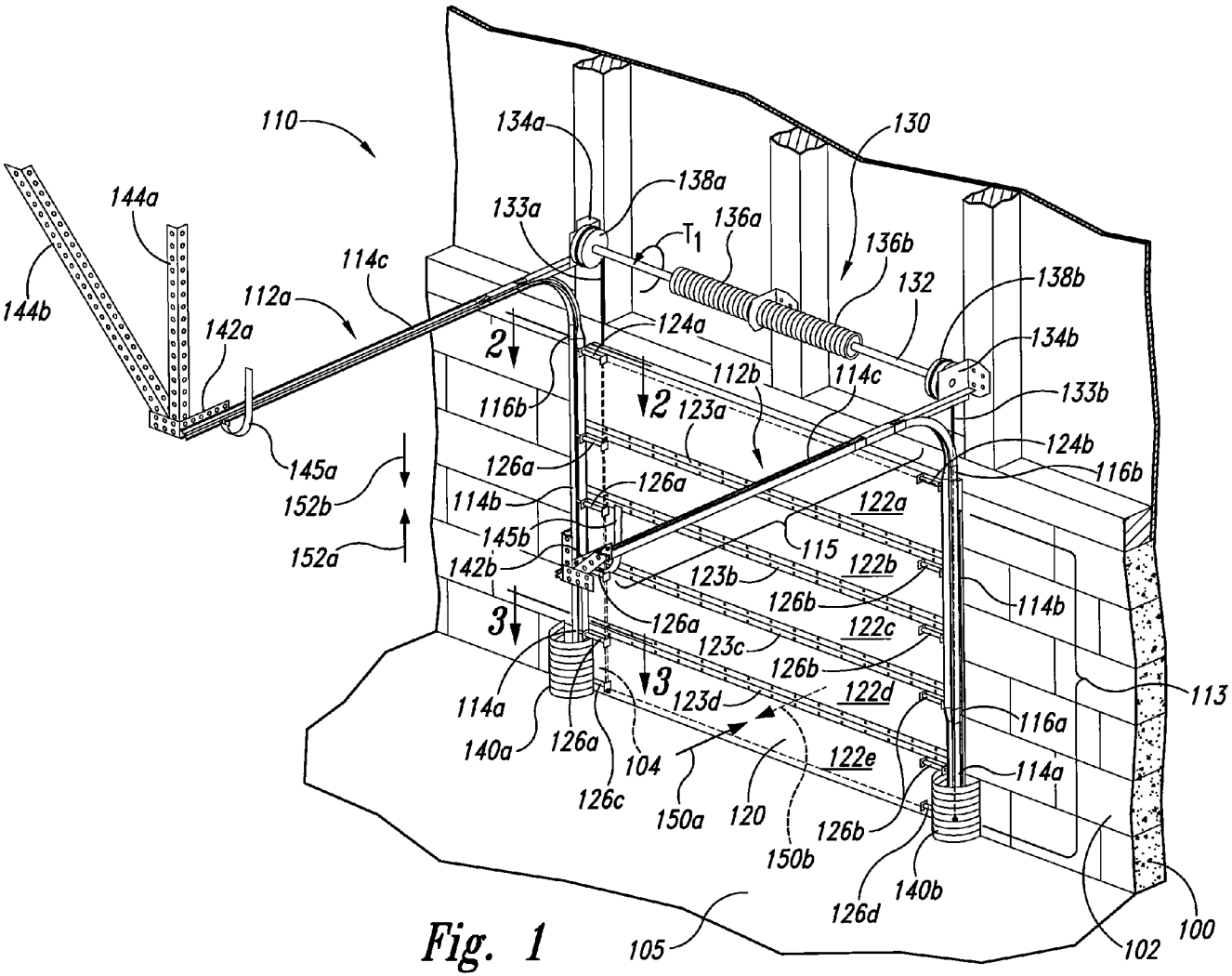
FIG. 1 is an isometric view of an overhead door assembly configured in accordance with an embodiment of the invention.

FIG. 1 is an isometric view of an overhead door assembly 110 configured in accordance with an embodiment of the invention. The overhead door assembly 110 ("door assembly 110") is installed in an opening 104 in a wall 102 of a building 100. The wall 102 can be part of a loading dock in a warehouse, factory, or other type of building 100. In other embodiments, however, the door assembly 110 can be installed in other types of commercial and non-commercial buildings.

The overhead door assembly 110 includes a sectional door 120 that is movably supported in opposing track assemblies 112 (identified individually as a left or first track assembly 112*a* and a right or second track assembly 112*b*). The sectional door 120 includes a plurality of rectangular door panels 122 (identified individually as door panels 122*a*-*e*) which are pivotally attached to each other along hinge lines 123 (identified individually as hinge lines 123*a*-123*d*). In one aspect of this embodiment, the first door panel 122*a* carries a first interlocking guide assembly 124*a* that movably engages the first track assembly 112*a*, and a second interlocking guide assembly 124*b* that movably engages the second track assembly 112*b*. In contrast, each of the remaining door panels 122*b*-*e* carries a first releasable guide assembly 126*a* that movably engages the first track assembly 112*a* at least proximate to the upper hinge line 123, and a second releasable guide assembly 126*b* that movably engages the second track assembly 112*b* at least proximate to the upper hinge line 123. In addition, the fifth door panel 122*e* carries a third releasable guide assembly 126*c* that movably engages the first track assembly 112*a* at least proximate to a lower edge of the door panel 122*e*, and a fourth releasable guide assembly 126*d* that movably engages the second track assembly 112*b* at least proximate to the lower edge of the door panel 122*e*. In other embodiments, overhead doors configured in accordance with the present disclosure can include other guide assembly arrangements that differ from that illustrated in FIG. 1. For example, in another embodiment, each of the door panels 122*a*-*d* can utilize the interlocking guide assemblies 124, and only the lowermost door panel 122*e* can utilize the releasable guide assemblies 126. In yet another embodiment, all of the door panels 122 can utilize the interlocking guide assemblies 124. Accordingly, the invention is not limited to the particular guide assembly configuration illustrated in FIG. 1.

In one aspect of this embodiment, the interlocking guide assemblies 124 can include an "interlocking" guide member that is retained in the adjacent track section when subjected to a force in an outward or first direction 150*a* or an inward or second direction 150*b*. In contrast, the releasable guide assemblies 126 can include a "releasable" guide member that disengages from the adjacent track section (thereby allowing the corresponding door panel 122 to be "knocked-out") when subjected to a sufficient force in one or both of the first direction 150*a* and/or the second direction 150*b*. These and other details of the guide assemblies 124 and 126 are described in greater detail below with reference to, for example, FIGS. 2 and 3.

In the illustrated embodiment, each of the track assemblies 112 includes a vertical segment 113 secured to the wall 102, and a non-vertical segment 115 which curves away from the wall 102 above the door opening 104. A guard rail 140, or a similar type of protective structure, can be installed around the lower portion of the vertical track segment 113 to protect it from damage from forklifts or other types of impacts. The distal ends of the non-vertical track segments 115 can be attached to an overhead support system 144 via a backhang bracket 142. The support system 144 can include a vertical member 144*a* and a diagonal member 144*b* having distal ends that are fixedly attached to adjacent building structures for support. A door bumper 145, made of spring steel or other suitable material, can be fixedly attached near the distal end of each of the non-vertical track segments 115 to absorb the kinetic energy of the door 120 as it moves into the overhead position.

Each of the track assemblies 112 includes a plurality of multi-piece track sections 114 (identified individually as a first track section 114*a*, a second track section 114*b*, and a third track section 114*c*) operably coupled together in functional alignment at a first transition section 116*a* and a second transition section 116*b*. In one aspect of this embodiment, each of the track sections 114*a-c* has a different cross-sectional shape that provides different door knock-out capabilities at different locations along the track. For example, in the illustrated embodiment, the cross-sectional shape of the first track section 114*a* allows the releasable guide assemblies 126 to disengage from the track section 114*a* when subjected to a force of a predetermined magnitude in the first direction 150*a*. This same cross-sectional shape, however, does not allow the releasable guide assemblies 126 to disengage from the first track section 114*a* when subjected to a force in the opposite, second direction 150*b*.

Turning now to the second track section 114*b*, this track section has a cross-sectional shape that allows the releasable guide assemblies 126 to disengage when subjected to a force of sufficient magnitude in either the first direction 150*a* or the second direction 150*b*. The third track section 114*c* has yet another cross-sectional shape that differs from both the first track section 114*a* and the second track section 114*b*. More specifically, the third track section 114*c* has a cross-sectional shape that retains both the releasable guide assemblies 126 and the interlocking guide assemblies 124 when the door 120 is in the overhead position, even when the door 120 is subjected to a substantial force in an upward or third direction 152*a* or a downward or fourth direction 152*b*. These and other features of the track sections 114 are described in greater detail below with reference to FIGS. 2-14. As those of ordinary skill in the art will appreciate, although they are identified by common reference numbers, in the illustrated embodiment the track sections 114 and the transition sections 116 on one side of the door opening 104 are essentially mirror images of the corresponding track sections 114 and transition sections 116 on the opposite side of the door opening 104.

In a further aspect of this embodiment, the overhead door assembly 110 also includes a counter balance system 130 fixedly attached to the building 100 above the door opening 104. The counter balance system 130 can include a first cable 133*a* and a second cable 133*b* which are attached to the lower-most door panel 122*e*. The counter balance cables 133 may also be attached to other door panels 122 at the top or bottom. Each of the cables 133 is operably coupled to a corresponding drum or cable drum 138 (identified individually as a first cable drum 138*a* and a second cable drum 138*b*). The cable drums 138 are fixedly attached to an axle 132 which is rotatably supported by opposing bearing supports 134*a* and 134*b*. A first coil spring 136*a* and a second coil spring 136*b* are operably wound about the axle 132, and exert a torsional force $T_1$ on the cable drums 138 which is proportional to the amount of cable extension. The torsional force $T_1$ puts the cables 133 in tension, making it easier for a person to lift the door 120 and allowing the door 120 to close or lower at a controlled rate of speed.

In operation, a person wishing to open the door 120 simply grasps the door 120 and lifts after disengaging any door locks (not shown). As the door 120 moves upwardly, the door panels 122 curve around the bends in the third track sections 114*c* and move inwardly on the non-vertical track segments 115 toward the bumpers 145. Although not shown in FIG. 1, in an alternate embodiment the overhead door assembly 110 can be equipped with an electric motor or other automated device for opening the door 120. With the door 120 stowed in the overhead position, personnel can transport goods and materials through the opening 104 by forklift, dolly, or other conveyance.

In the embodiment of FIG. 1, the door 120 moves upwardly and then away from the wall 102 in a horizontal direction. In other embodiments, however, an overhead door configured in accordance with the present disclosure can move away from the opening 104 in multiple directions. For example, the door 120 can move along tracks that extend away from the wall 102 at any angle from about 0 degrees (i.e., parallel to the wall 102) to about 90 degrees (i.e., horizontal, as shown in FIG. 1). Accordingly, those of ordinary skill in the relevant art will appreciate that the present invention is not limited to the particular embodiment disclosed in FIG. 1, but extends to other embodiments incorporating the inventive features disclosed herein.

Figure 2:
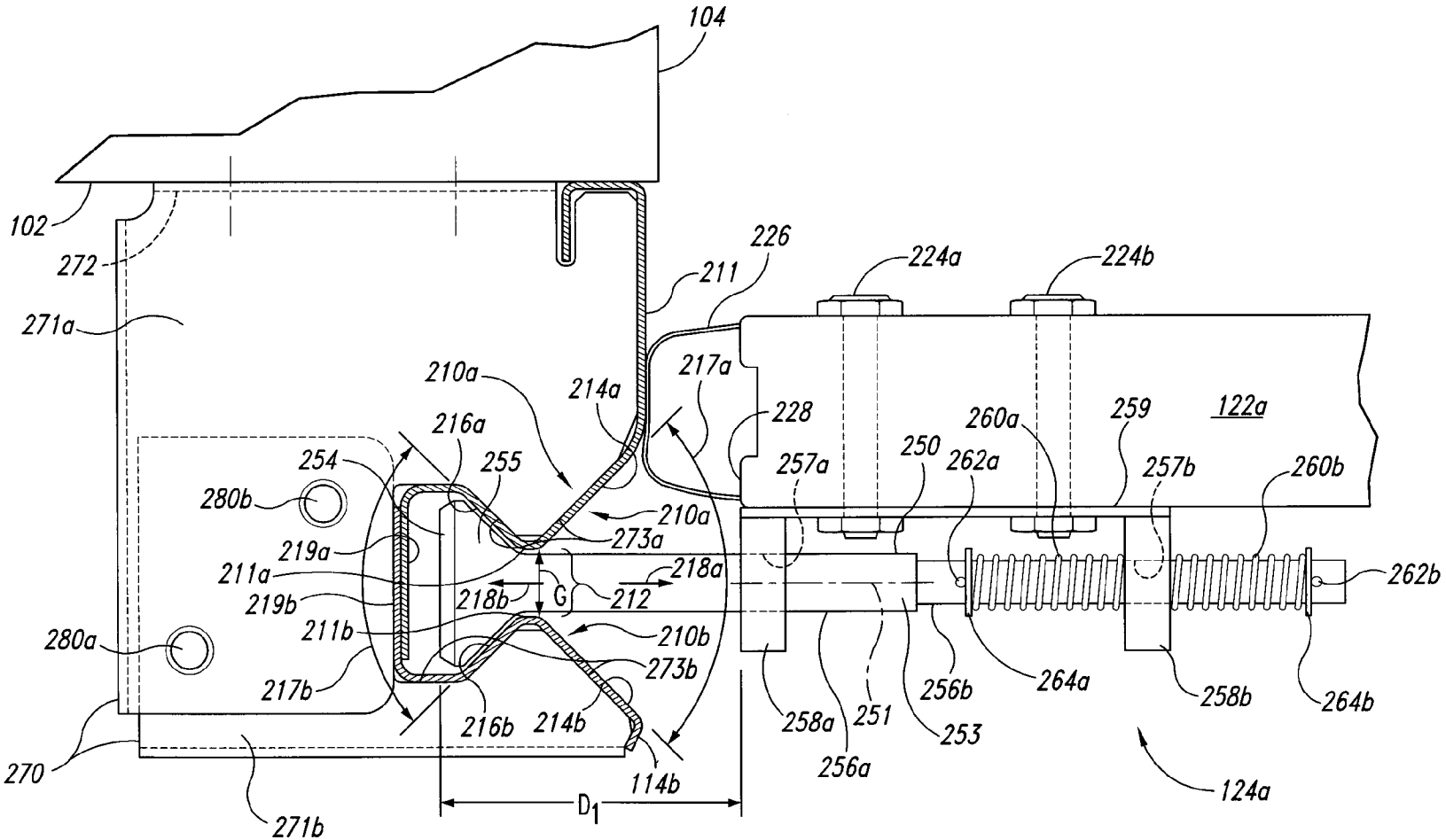
FIG. 2 is an enlarged, cross-sectional end view of a track section and guide assembly configured in accordance with an embodiment of the invention.

FIG. 2 is an enlarged, cross-sectional end view taken along line 2-2 in FIG. 1, showing the interlocking guide assembling 124*a* movably engaged with the second track section 114*b* in accordance with an embodiment of the invention. In one aspect of this embodiment, the second track section 114*b* is formed from two separate side portions 210 (identified individually as a first side portion 210*a* and a second side portion 210*b*) which are joined together along overlapping flanges 219 (identified individually as a first flange 219*a* and a second flange 219*b*). As described in greater detail below, in one embodiment the flanges 219 can be joined together by a plurality of "clinched" connections formed by a process known as "clinching." In other embodiments, however, the flanges 219 can be joined together using a number of different techniques including, for example, fastening with rivets, screws, bolts, etc., bonding, welding, and/or other suitable methods known in the art.

The first side portion 210*a* is spaced apart from the second side portion 210*b* to define a channel or gap region 212 therebetween. The gap region 212 defines a gap dimension G. The first side portion 210*a* includes a first guide surface 214*a*, a first retention surface 216*a*, and a first corner portion 211*a* positioned between the first guide surface 214*a* and the first retention surface 216*a*. Similarly, the second side portion 210*b* includes a second guide surface 214*b*, a second retention surface 216*b*, and a second corner portion 211*b* positioned between the second guide surface 214*b* and the second retention surface 216*b*. In the illustrated embodiment, the first and second guide surfaces 214 diverge from the gap region 212 in a fifth direction 218*a* to form a first "V-groove," and the first and second retention surfaces 216 diverge from the gap region 212 in a sixth direction 218*b*, opposite to the fifth direction 218*a*, to form a second "V-groove." More specifically, in the illustrated embodiment, the first guide surface 214*a* is disposed at a first angle 217*a* of from about 60 degrees to about 120 degrees, e.g., about 90 degrees relative to the second guide surface 214*b*. The first retention surface 216*a* can be disposed at a second angle 217*b* of from about 40 degrees to about 180 degrees relative to the second retention surface 216*b*. For example, in one embodiment the first retention surface 216*a* can be disposed at a second angle 217*b* of from about 60 degrees to about 160 degrees, e.g., about 120 degrees relative to the second retention surface 216*b*. As described in greater detail below, however, in other embodiments the first and second guide surfaces 214, and/or the first and second retention surfaces 216, can be disposed at other angles, or be parallel, relative to each other.

In addition to the foregoing surfaces, the second track section 114*b* further includes a seal surface 211 extending outwardly from the first guide surface 214*a*. As illustrated in FIG. 2, the first door panel 122*a* carries a compressible door seal 226 that slideably contacts the seal surface 211. The door seal 226 can be manufactured from rubber, polyurethane, foam, and/or any other suitable material known in the art.

In one embodiment, the side portions 210 can be formed with a brake press from a suitable sheet metal, such as galvanized steel having a thickness ranging from about 10 gauge to about 20 gauge, e.g. about 16 gauge. In other embodiments, the side portions 210 can be roll- or press-formed from a suitable sheet metal. One advantage of making the track sections 114 from two (or more) pieces of formed sheet metal is that the individual side portions 210 have shapes that are relatively easy to form by conventional brake- and roll-forming methods. In further embodiments, however, the side portions 210, and/or other overhead door track components embodying the inventive features disclosed herein can be machined, cast, molded or otherwise formed from other metallic (e.g., aluminum) and non-metallic (e.g., plastics, composites, etc.) materials having suitable strength, stiffness, forming, cost, and/or other characteristics. In still other embodiments, one or more of the track sections 114 can be formed from a single piece of material instead of from two (or more) pieces of material. For example, in such embodiments, one or more of the track sections 114 can be formed (e.g., brake-formed, roll-formed, etc.) from a single piece of suitable sheet metal, or cast, machined, molded or otherwise formed as a unitary piece form suitable metallic and non-metallic materials. Accordingly, those of ordinary skill in the art will appreciate that aspects of the present invention are not limited to the particular manufacturing methods disclosed herein.

In another aspect of this embodiment, the interlocking guide assembly 124*a* includes an interlocking guide member 250 that projects outwardly from a door edge region 228 a distance $D_1$ along a longitudinal axis 251 of the guide member 250 which extends at least approximately parallel to the door panel 122*a*. The interlocking guide member 250 includes a cylindrical shaft 253 having a first shaft portion 256*a* and a smaller-diameter second shaft portion 256*b*. The first shaft portion 256*a* extends through a first aperture 257*a* in a first journal 258*a*. The second shaft portion 256*b* extends from the first shaft portion 256*a* through a coaxial second aperture 257*b* in a second journal 258*b*. The journals 258 are carried by a bracket 259 which is fixedly attached to the first door panel 122*a* by a plurality of bolts 224 or other suitable fasteners and/or methods known in the art.

In a further aspect of this embodiment, the distal end of the first shaft portion 256*a* carries an enlarged head portion 254 that is movably retained by the retention surfaces 216 of the second track section 114*b*. In the illustrated embodiment, the enlarged head portion 254 flares outwardly from the first shaft portion 256*a* to form a reverse conical, or at least generally conical, surface 255. Moreover, in the illustrated embodiment the angle of the surface 255 is at least generally similar, or at least approximately parallel, to the angle 217*b* between the adjacent retention surfaces 216. In other embodiments, however, other configurations of interlocking guide members and associated track sections can be employed without departing from the spirit or scope of the present disclosure. For example, in other embodiments consistent with the present disclosure, the enlarged head portion 254 can have other shapes, such as spherical shapes, cylindrical shapes, etc., and the adjacent track surfaces can have other shapes that may or may not reflect the shape of the enlarged head portion. In still further embodiments, interlocking guide members can include rollers or similar devices attached to the distal end of the first shaft portion 256*a* to function as the enlarged head portion 254. As the foregoing illustrates, the present invention is not limited to the particular interlocking guide assembly illustrated in FIG. 2, but extends to other embodiments incorporating the inventive features disclosed herein.

In another aspect of this embodiment, the second shaft portion 256*b* carries first and second biasing members or coil springs 260*a, b* which are compressed against opposite sides of the second journal 258*b* and held in place by washers 264 and associated pins 262. The washers 264 and the pins 262 can be replaced by E-rings or other suitable retainers. The coil springs 260 permit the guide member 250 to move back and forth along the longitudinal axis 251 a preset distance, such as from about 0.1 inch to about 0.5 inch, e.g., about 0.25 inch. This movement enables the guide member 250 to accommodate minor misalignments of the track section 114*b* without binding. In the illustrated embodiment, the second interlocking guide assembly 124*b* can be the same as, or at least generally similar in structure and function to, the first interlocking guide assembly 124*a*.

A track bracket 270 fixedly attaches the second track section 114*b* to the wall 102. In one aspect of this embodiment, the track bracket 270 includes a first fitting 271*a* joined to a second fitting 271*b*. The first fitting 271*a* can include a mounting flange 272 through which one or more fasteners can extend to attach the first fitting 271*a* to the wall 102. The first fitting 271*a* can also include a first edge region 273*a* having a first profile shape that at least approximates the cross-sectional shape of the first side portion 210*a*. Similarly, the second fitting 271*b* can include a second edge region 273*b* having a second profile shape that at least approximates the cross-sectional shape of the second side portion 210*b*. During assembly of the track section 114*b* (FIG. 1), the first fitting 271*a* can be fitted against the first side portion 210*a*, and the second fitting 271*b* can be independently fitted against the second side portion 210*b*. The overlapping portions of the first and second fittings 271 can then be joined together to provide close-fitting support for the operable surfaces of the second track section 114*b*.

In one embodiment, the overlapping portions of the first and second fittings 271 can be joined together with one or more "clinched" connections 280 (identified individually as a first clinch 280*a* and a second clinch 280*b*). Clinching is a method of joining two pieces of sheet metal by pressing them together with a die that forms a connection similar to a rivet. Hand operated clinching tools are typically hydraulically driven, and make a connection by driving a punch into the die through overlapping material. When the material is forced to the bottom of the die, the material begins to mushroom and expands to allow full development of the connection. When the punch reaches its force limit, it is withdrawn. The result is a connection very similar to a riveted connection.

In other embodiments, the first and second fittings 271 can be joined together using a wide variety of joining techniques known in the art including, for example, fastening with rivets, bolts, screws, etc., bonding with adhesives, and welding, soldering, brazing, etc.

Figure 3:
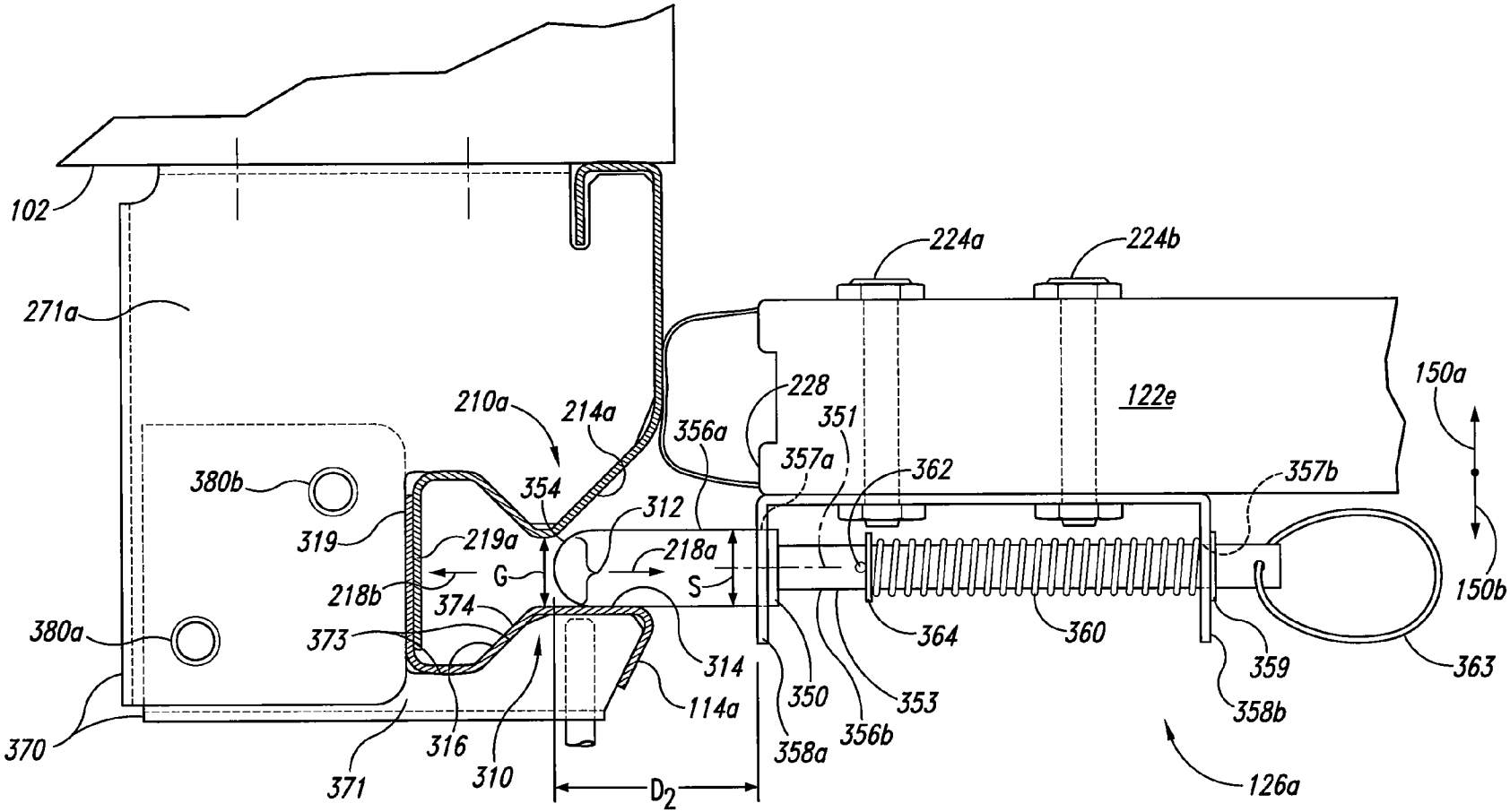
FIG. 3 is an enlarged, cross-sectional end view of a track section and guide assembly configured in accordance with another embodiment of the invention.

FIG. 3 is an enlarged, cross-sectional end view taken along line 3-3 in FIG. 1, showing the releasable guide assembly 126*a* movably engaged with the first track section 114*a* in accordance with an embodiment of the invention. Many features of the first track section 114*a* are at least generally similar in structure and function to corresponding features of the second track section 114*b* described above with reference to FIG. 2. For example, in the illustrated embodiment the first track section 114*a* is formed from a third side portion 310 that is joined to the first side portion 210*a* described above with reference to FIG. 2. The third side portion 310 can be joined to the first side portion 210*a* with, for example, a series of clinched connections that extend through a third flange 319 which overlaps the first flange 219*a*.

The first side portion 210*a* is spaced apart from the third side portion 310 to define a gap region 312 therebetween. The third side portion 310 includes a third guide surface 314 and a third retention surface 316. Unlike the second track section 114*b* described above, however, in this embodiment the third guide surface 314 is at least approximately parallel to the door 120 (FIG. 1).

In another aspect of this embodiment, the releasable guide assembly 126*a* includes a releasable guide member 350 that projects outwardly from the door edge region 228 along a longitudinal axis 351 that is least approximately parallel to the third guide surface 314. The releasable guide member 350 lacks the enlarged head portion 254 of the interlocking guide member 250 described above with reference to FIG. 2. More specifically, the releasable guide member 350 includes a cylindrical shaft 353 having a first shaft portion 356*a* and a smaller-diameter second shaft portion 356*b*. The first shaft portion 356*a* extends through a first aperture 357*a* in a first journal 358*a*. The first shaft portion 356*a* has a constant, or at least approximately constant, diameter S until it reaches a hemispherical, or at least approximately hemispherical head portion 354. The second shaft portion 356*b* extends from the first shaft portion 356*a* through a coaxial second aperture 357*b* in a second journal 358*b*.

The second shaft portion 356*b* passes through a coil spring 360 that is compressed between the second journal 358*b* and a washer 364 which is held in place by a pin 362. The washer 364 and the pin 362 can be replaced by an E-ring or other suitable retainer. The coil spring 360 allows a rounded head portion 354 of the first shaft portion 356*a* to move inwardly in the fifth direction 218*a* a preset distance, such as from about 0.5 inches to about 1.5 inches, e.g., about 1.25 inches. The coil spring also urges the rounded head portion 354 outwardly in the sixth direction 218*b* toward the first track section 114*a*. In the illustrated embodiment, the gap dimension G is smaller than the diameter S to prevent interference of the head portion 354 with the gap region 212 during door operation. If this were to happen, it could impede the knock-out capability of the releasable guide member 350. The first shaft portion 356*a*, or parts thereof, can be made from a suitable polymer material, such as plastic, Delrin®, Teflon®, etc. to reduce friction between it and the track section 114*b*. An E-ring or other type of retainer 359 is fixedly attached to the second shaft portion 356*b* to prevent the head portion 354 from projecting beyond a distance $D_2$ from the edge portion 228 of the fifth door panel 122*e*. The distance $D_2$ is less than the distance $D_1$ discussed above with reference to FIG. 2, to facilitate the knock-out capability of the releasable guide member 350 during normal door operation.

The parallel guide surface 314 can prevent the releasable guide member 350 from disengaging from the first track section 114*a* when the fifth door panel 122*e* sustains a force in the inward direction 150*b*. However, the releasable guide member 350 can still be disengaged or "knocked-out" of the first track section 114*a* if the fifth door panel 122*e* sustains a force of sufficient magnitude in the outward direction 150*a*. For example, when the door panel 122*e* is subjected to a force of sufficient magnitude in the first direction 150*a*, the force causes the rounded head portion 354 of the guide member 350 to bear against the first guide surface 214*a*. The angle of the guide surface 214*a* causes the guide member 350 to retract inwardly in the fifth direction 218*a* as the door panel 122*e* continues moving outwardly. Once the head portion 354 is sufficiently retracted, the releasable guide member 350 moves free of the "V groove" formed by the guide surfaces 214*a* and 314. The releasable guide member 350 can be knocked-out of the second track section 114*b* in both the outward direction 150*a* and the inward direction 150*b* in the same manner. The releasable guide assembly 126*a* can also include a D-ring or other type of pull feature 363 for manually retracting the releasable guide member 350 if desired for door panel removal, installation, or reinstallation. In the illustrated embodiment, the releasable guide assemblies 126*b-d* can be the same as, or at least generally similar in structure and function to, the releasable guide assembly 126*a*.

A track bracket 370 fixedly attaches the first track section 114*a* to the wall 102. Many features of the track bracket 370 are at least generally similar in structure and function to corresponding features of the track bracket 270 described above with reference to FIG. 2. For example, the track bracket 370 includes a third fitting 371 that is joined to the first fitting 271*a* described above with reference to FIG. 2. Like the first fitting 271*a*, the third fitting 371 can include a third edge region 373 having a third profile shape that at least approximates the cross-sectional shape of the third side portion 310. During assembly of the vertical track segment 113 (FIG. 1), the first fitting 271*a* can be fitted against the first side portion 210*a*, and the third fitting 371 can be independently fitted against the third side portion 310. The overlapping portions of the first fitting 271*a* and the third fitting 371 can then be joined together with, for example, one or more clinch connections 380 (identified individually as a first clinch connection 380*a* and a second clinch connection 380*b*). In other embodiments, the third fitting 371 can be attached to the first fitting 271*a* by other suitable means including, for example, rivets, screws, bolts, adhesives, welds, etc.

There are a number of advantages associated with the embodiments of the invention described above with reference to FIGS. 1-3. For example, one advantage is that the interlocking guide member 250 can eliminate the need for a spreader bar that spans between the opposing track assemblies 112 to help hold the tracks in position. The added stiffness of the track brackets (e.g., the track brackets 270 and 370) can also increase the wind load capacity of the door 120. Yet another advantage of the embodiments described above is that the diverging guide surfaces 214 of the second track section 114*b* provides the door 120 with double knock-out capability (i.e., both inward and outward knock-out capability) for all but the upper-most door panel 122*a*.

Figure 4:
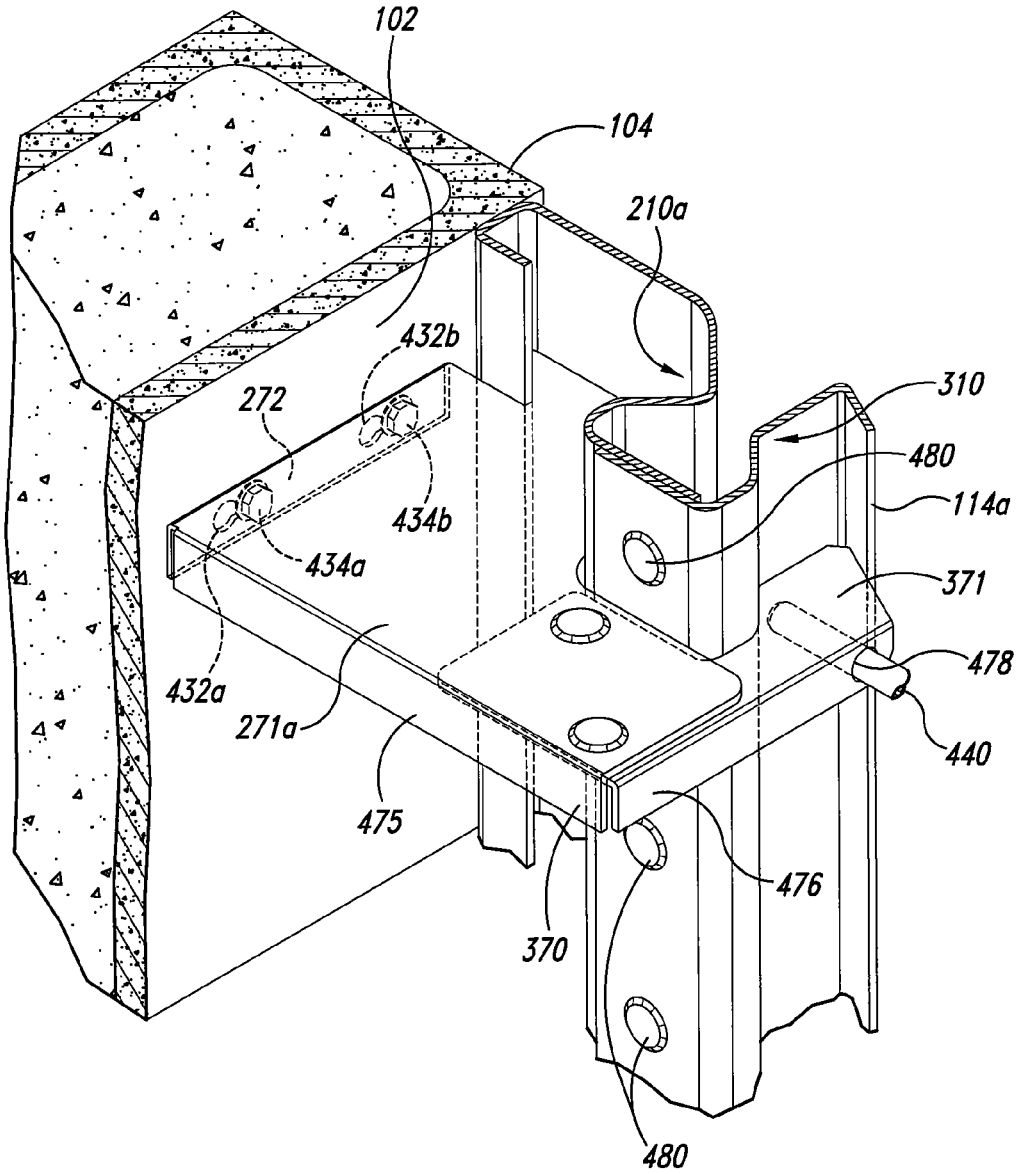
FIG. 4 is an enlarged isometric view of the track bracket and track section shown in FIG. 3.

FIG. 4 is an isometric view of the track bracket 370 described above with reference to FIG. 3. The mounting flange 272 of the first fitting 271*a* can include a plurality of apertures 432 (identified individually as a first aperture 432*a* and a second aperture 432*b*). In the illustrated embodiment, the apertures 432 have keyhole shapes that receive bolts or other suitable fasteners 434 for attaching the first fitting 271*a* to the wall 102. The keyhole shape allows the fastener closest to the door jamb (i.e., the second fastener 434*b*) or the "primary anchor" to be installed in the wall 102 prior to placing the track section 114*a* in position. Once the primary anchors for all or some of the other track brackets have been installed in the wall 102 (but not fully torqued or otherwise fully installed), the track bracket 370 and the other track brackets (with the track section 114*a* attached) can be positioned against the wall 102 and slid horizontally into the proper position relative to the door opening 104. Once the track section 114*a* is in the desired position, the primary anchors can be tightened to hold the track section 114*a* in position while the secondary anchors (e.g., the first fastener 434*a*) are installed.

In another aspect of this embodiment, the first fitting 271*a* can include a first stiffening flange 475, and the third fitting 371 can include a second stiffening flange 476. The stiffening flanges 475 and 476 add rigidity to the track bracket 370 which helps the door system achieve higher design pressure capabilities due to wind loads and other factors. In addition, the second stiffening flange 476 can include a round hole or other aperture 478 for removably receiving a pin 440 (e.g., a wind load clevis pin, security lock, and/or other feature). In selected embodiments, the pin 440 can operably couple a reinforcing structure on the door 120 (not shown) to the track bracket 370 to increase wind load capability when the door 120 is in the closed position.

As shown to good effect in FIG. 4, the first side portion 210*a* of the first track section 114*a* can be fixedly attached to the third side portion 310 by a series of clinched connections 480. In other embodiments, however, the first side portion 210*a* can be fixedly attached to the third side portion 310 by various types of other fasteners including, for example, rivets, bolts, screws, etc. Alternatively, the opposing side portions 210/310 can be joined together with adhesives, and various types of welding, soldering, and/or brazing techniques.

Clinching may advantageously reduce the manufacturing and tooling costs of producing the various track components described above. In addition, the protrusions caused by the clinched connections 480 can also be used to define track bracket attachment locations. For example, the track installer can adjust the position of the bracket 470 in the field by sliding it within the area defined between two adjacent clinch protrusions.

In one embodiment, the track brackets described above (e.g., the brackets 270 and 370) can be clinched together at the factory to ensure a relatively tight fit between the track bracket and the adjacent track section. Furthermore, the track brackets can be properly positioned in the factory so that they can best support plunger loads imparted by the door due to impacts and wind loads when the door is in the "closed" position.

Figure 5:
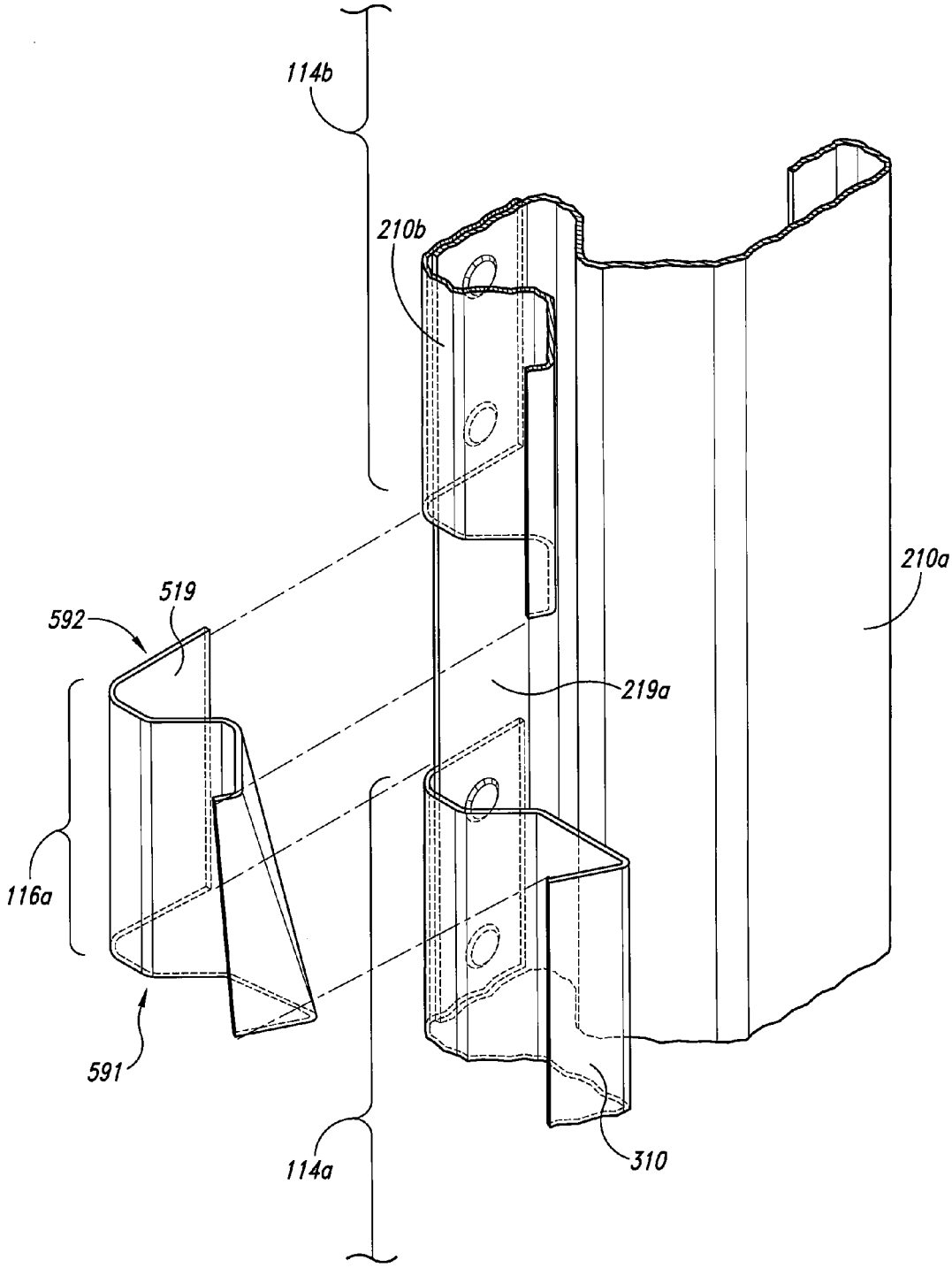
FIG. 5 is a partially exploded, enlarged isometric view illustrating a transition between a first track section and a second track section, in accordance with an embodiment of the invention.

FIG. 5 is a partially exploded, enlarged isometric view illustrating the transition between the first track section 114*a* and the second track section 114*b*, as shown in FIG. 1. Referring to FIGS. 1 and 5 together, in one aspect of this embodiment, on the outward side both the first track section 114*a* and the second track section 114*b* utilize the first side portion 210*a*. More specifically, the first side portion 210*a* extends from the floor 105 and continues to above the top of the door opening 104 (i.e., at or above the door header). In contrast, however, on the inward side the first track section 114*a* utilizes the third side portion 310, while the second track section 114*b* utilizes the second side portion 210*b*.

The first transition section 116*a* accommodates the transition between the third side portion 310 and the second side portion 210*b*. More specifically, as illustrated in FIG. 5, the first transition section 116*a* includes a first end portion 591 having a first cross-sectional shape that at least approximates the cross-sectional shape of the third side portion 310. The first transition section 116*a* also includes a second end portion 592 having a second cross-sectional shape that at least approximates the cross-sectional shape of the second side portion 210*b*. Accordingly, when a third flange 519 of the first transition section 116*a* is clinched or otherwise joined to the first flange 219*a* of the first side portion 210*a*, the first transition section 116 provides a relatively smooth transition from the first track section 114*a* to the second track section 114*b*. Since, in one embodiment, the second track assembly 112*b* is essentially a mirror image of the first track assembly 112*a*, the second track assembly 112*b* will require a transition section that is a mirror image of the first transition section 116*a*.

Figure 6A:
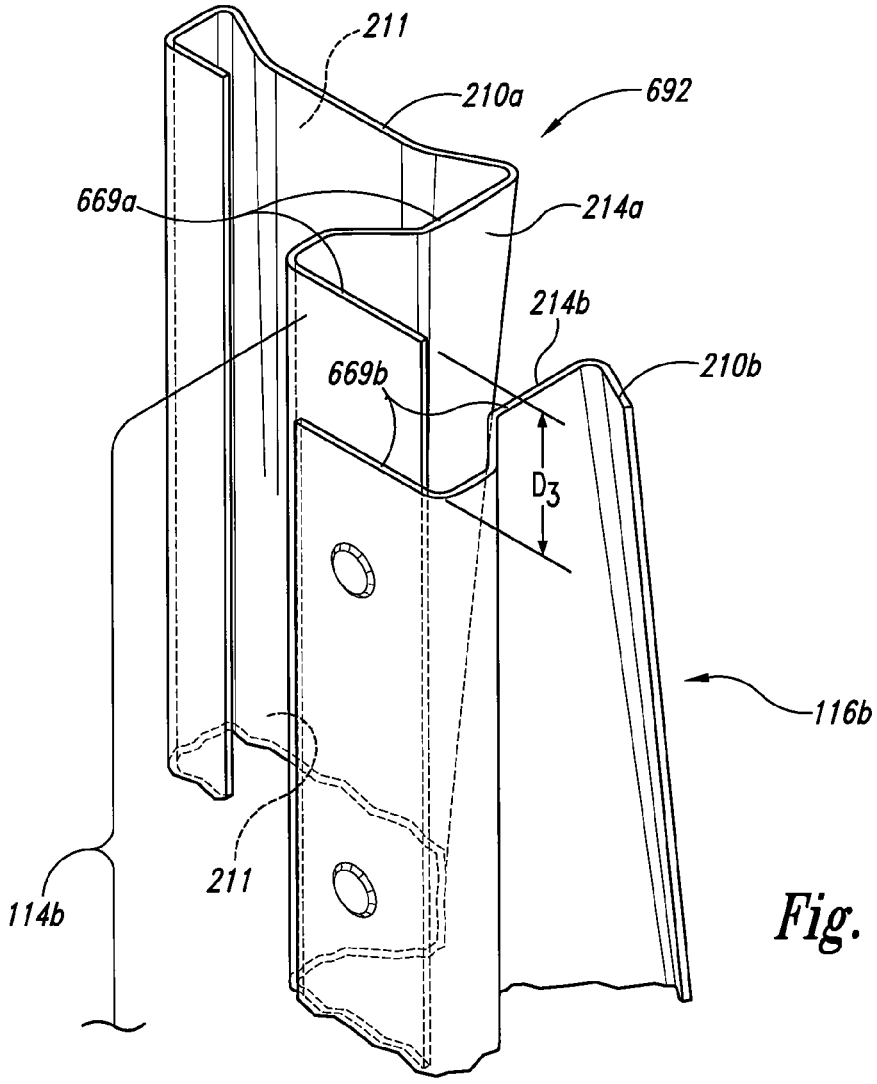
FIG. 6A is an enlarged isometric view of an upper end portion of a first track section.
Figure 6B:
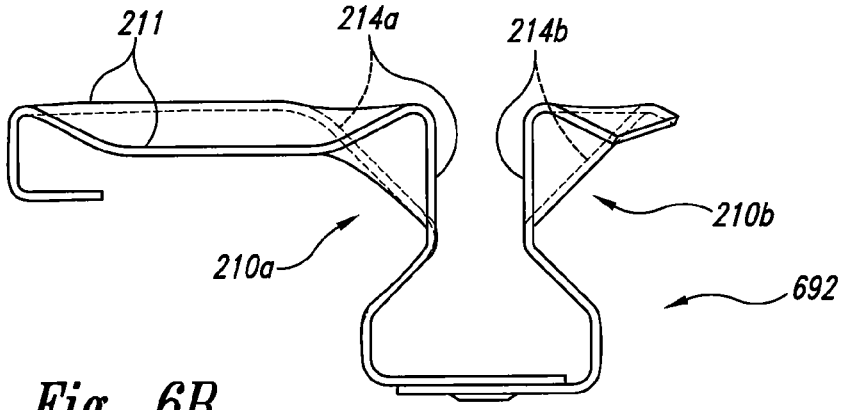
FIG. 6B is a top end view of the track section shown in FIG. 6A.

FIG. 6A is an enlarged isometric view of an upper end portion 692 of the second track section 114*b* of FIG. 1, and FIG. 6B is a top end view of the upper end portion 692 shown in FIG. 6A. Referring to FIGS. 6A and 6B together, the first guide surface 214*a* of the first side portion 210*a* angles inwardly as it approaches the upper end portion 692 until it is parallel to the door 120 (FIG. 1) at a first upper edge 669*a*. Similarly, the second guide surface 214*b* of the second side portion 210*b* is angled inwardly near the upper end portion 692 until it is parallel to the door 120 (FIG. 1) at a second upper edge 669*b*, which is offset from the first upper edge 669*a* by a distance $D_3$. Accordingly, the angle between the opposing guide surfaces 214*a,b* becomes narrower as they approach the upper edges 669, to the point that the guide surfaces 214 are at least approximately parallel to each other at the upper edges 669. In addition, the seal surface 211 recedes as it approaches the first upper edge 669*a* so that the door seal 226 (FIG. 2) will not rub against the seal surface 212 when the door moves into the overhead position.

Figure 7A:
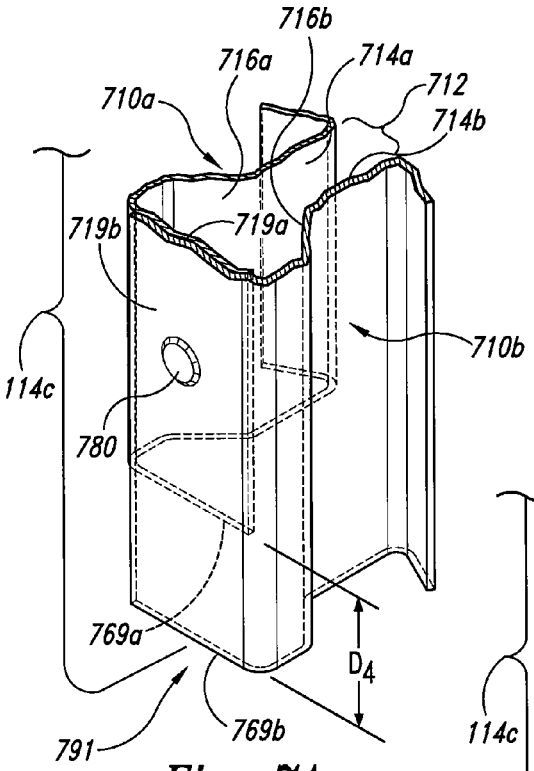
FIG. 7A is an enlarged isometric view of a lower end portion of a second track section that mates to the upper end portion of the first track section shown in FIG. 6A, and FIG. 7B an enlarged isometric view illustrating the connection between the first track section and the second track section.
Figure 7B:
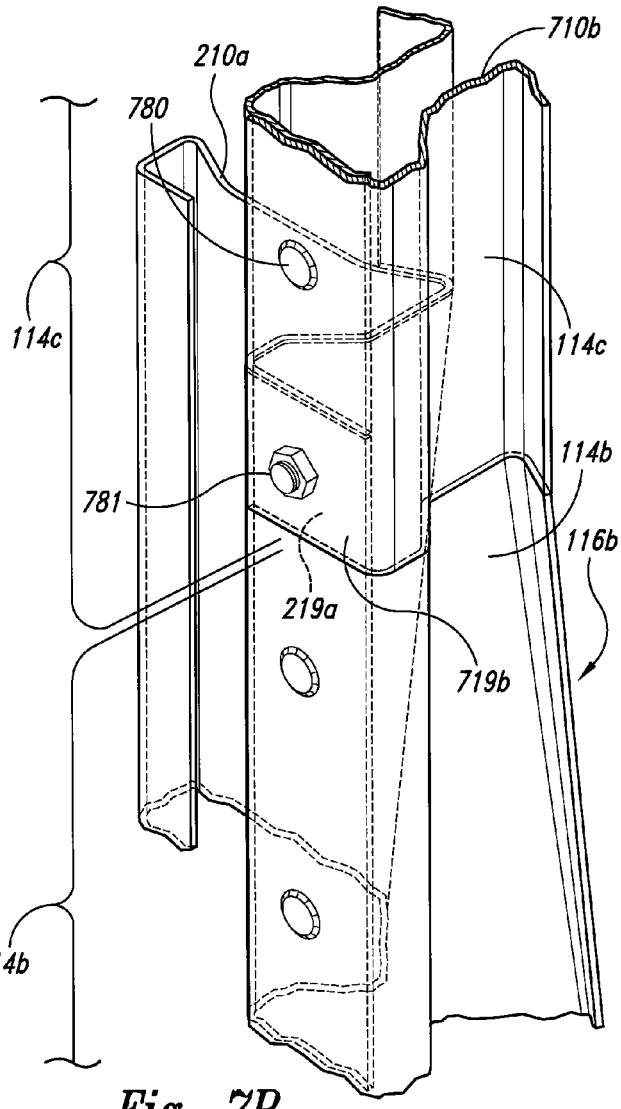

FIG. 7A is an enlarged isometric view of a lower end portion 791 of the third track section 114*c* that mates to the upper end portion 692 of the second track section 114*b* discussed above with reference to FIGS. 6A and 6B. FIG. 7B is an enlarged isometric view illustrating the second transition section 116*b* between the second track section 114*b* and the third track section 114*c*. Referring first to FIG. 7A, the third track section 114*c* includes a fourth side portion 710*a* spaced apart from a fifth side portion 710*b* to define a gap region 712 therebetween. Each of the side portions 710 includes a corresponding guide surface 714 (identified individually as a first guide surface 714*a* and a second guide surface 714*b*) which are at least approximately parallel to the door 120 (FIG. 1) and the longitudinal axes of the corresponding door guide members. Each of the side portions 710 also includes a retention surface 716 (identified individually as a first retention surface 716*a* and a second retention surface 716*b*) which are at least generally similar in structure and function to the retention surfaces 216 described above with reference to FIG. 2. In addition, each of the side portions 710 includes a corresponding flange 719 (identified individually as a first flange 719*a* and a second flange 719*b*) which overlap each other and are joined together with a plurality of clinched connections 780 and/or other suitable fastening techniques. In a further aspect of this embodiment, the fourth side portion 710*a* includes a first lower edge 769*a*, and the fifth side portion 710*b* includes a second lower edge 769*b* that is offset from the first edge 769*a* by a distance $D_4$ which corresponds to the offset distance $D_3$ discussed above in reference to FIG. 6A.

Referring next to FIG. 7B, the second track section 114*b* is fixedly attached to the third track section 114*c* in end-to-end alignment by at least one fastener 781 extending through the second flange 719*b* of the fifth side portion 710*b* and the first flange 219*a* of the first side portion 210*a*. In one embodiment, this track connection can be made in the field, and as such the fastener 781 can be screw, bolt, rivet, or other form of attachment (e.g., adhesive or brazing) that can be implemented in the field during final assembly of the track sections. One advantage of using overlapping surfaces to attach the second track section 114*b* to the third track section 114*c* in this manner is that it eliminates the need for additional brackets, clips and/or other types of hardware to structurally attach the two track sections together.

Figure 8:
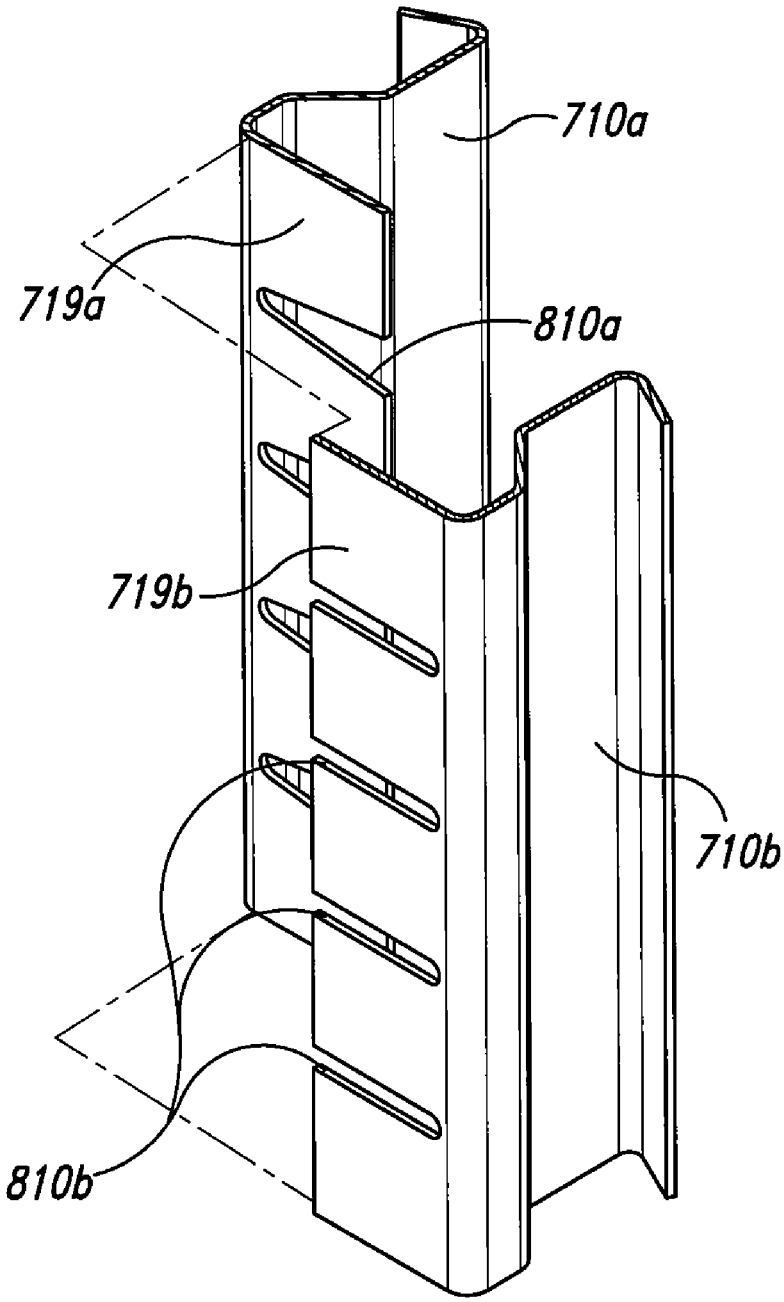
FIG. 8 is an isometric view illustrating two track side portions prior to forming into a desired radius.

FIG. 8 is an isometric view illustrating the fourth side portion 710*a* and the fifth side portion 710*b* of the third track section 114*c* prior to forming these side portions to the desired radius of the third track section 114*c*, as shown in FIG. 1. In one aspect of this embodiment, the first flange 719*a* of the fourth side portion 710*a* includes a plurality of tapered slots 810*a* that open outwardly toward the outer edge of the first flange 719*a*. The second flange 719*b* of the fifth side portion 710*b* includes a plurality of straight slots 810*b*. As described in greater detail below with reference to FIG. 9, the slots 810 facilitate forming of the respective side portions 710 into the desired radius of curvature before the two side portions are joined together to form the third track section 114*c*.

Figure 9:
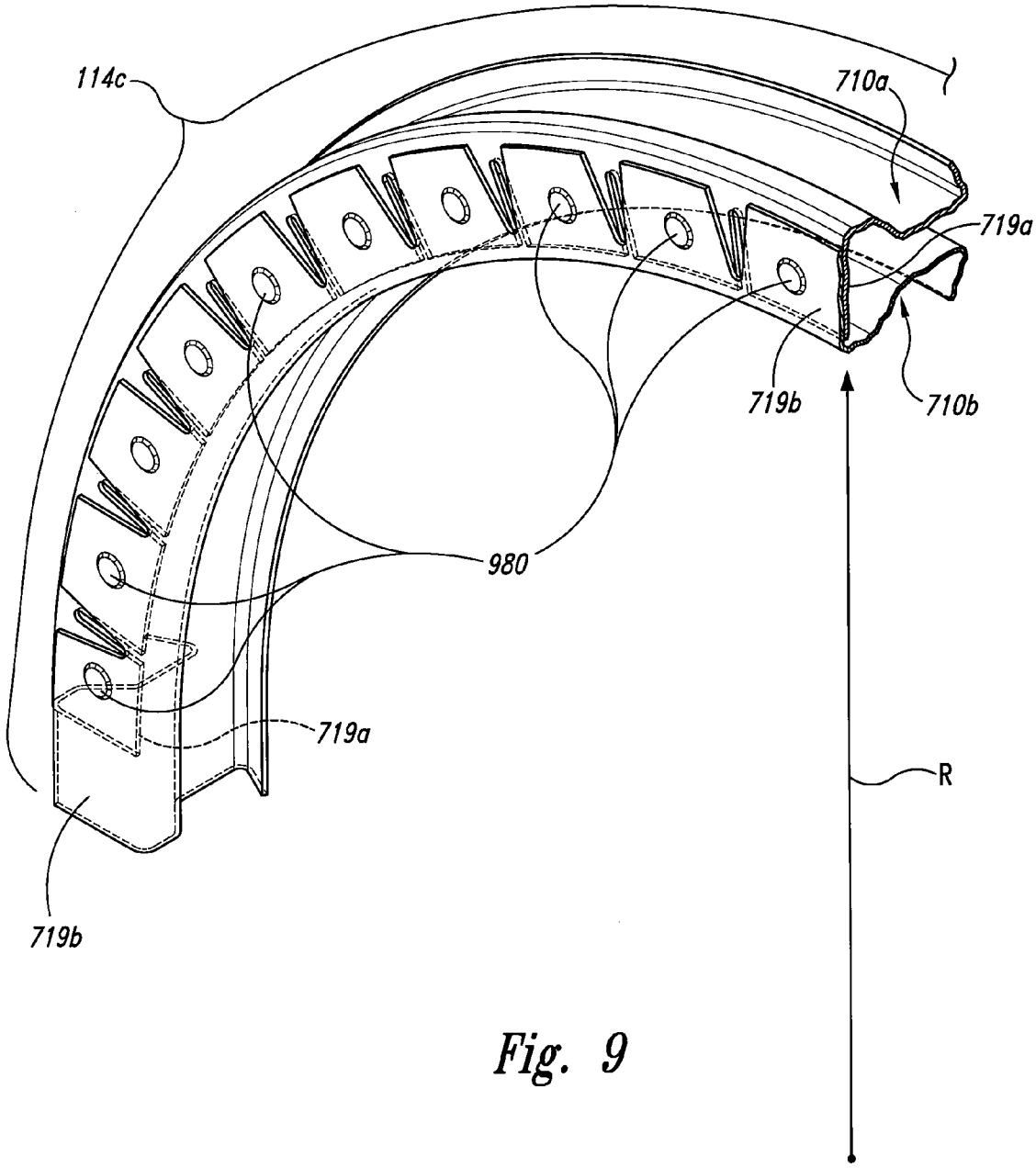
FIG. 9 is an isometric view of a curved portion of door track configured in accordance with an embodiment of the invention.

FIG. 9 is an isometric view of the curved portion of the third track section 114*c*, showing the fourth side portion 710*a* joined to the fifth side portion 710*b*. As this view illustrates, the tapered slots 810*a* in the fourth side portion 710*a* close up as the fourth side portion 710*a* is rolled or otherwise formed to a radius R. In contrast, the straight slots 810*b* of the fifth side portion 710*b* open up somewhat as the fifth side portion 710*b* is formed to the radius R. Once the respective side portions 710 have been formed to the desired radius, they can be joined together by a series of clinched connections 980 that extend through the overlapping flanges 719, or by other suitable joining techniques known in the art.

FIGS. 8 and 9 illustrate one approach for forming curved track sections in which the respective flanges include a plurality of tapered slots and/or straight slots. In other embodiments, however, the tapered slots 810*a* and/or the straight slots 810*b* can be omitted, and the curved track portion of the third track section 114*c* can be formed with side portions that do not include any tapered or straight lots.

Figure 10:
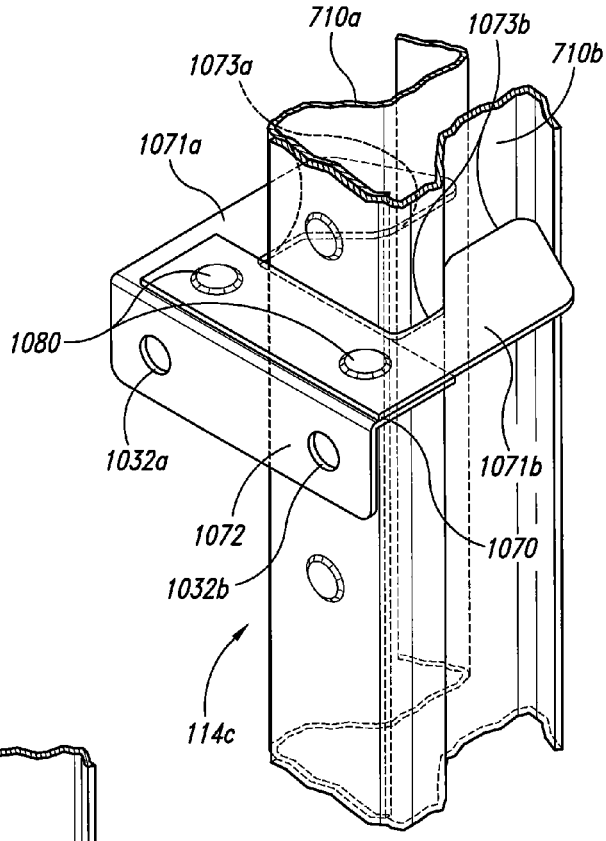
FIG. 10 is an enlarged isometric view of a track bracket operably coupled to a door track section in accordance with a further embodiment of the invention.

FIG. 10 is an isometric view of a track bracket 1070 operably coupled to a portion of the third track section 114*c* in accordance with another embodiment of the invention. In one aspect of this embodiment, the track bracket 1070 includes a first fitting 1071*a* and a second fitting 1071*b*. Each of the fittings 1071 includes a corresponding edge region 1073 that is contoured or shaped to receive the adjacent surfaces of the corresponding side portion 710 of the track section 114*c*. The fittings 1071 can be installed at an appropriate location on the third track section 114*c*, and then joined together with one or more clinched connections 1080. In one aspect of this embodiment, the first fitting 1071*a* includes a mounting flange 1072 that includes one or more apertures 1032 (identified individually as a first aperture 1032*a* and a second aperture 1032*b*). The apertures 1032 can be used to fixedly attach the track bracket 1070 to a portion of the building structure to stabilize the radius and other portions of the third track section 114*c*.

Figure 11:
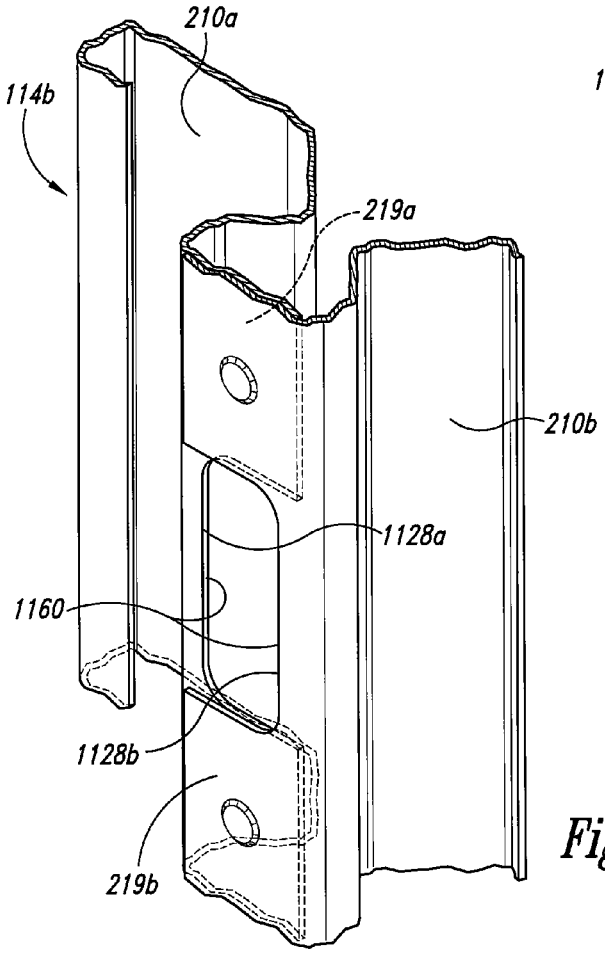
FIG. 11 is an enlarged isometric view illustrating a track aperture configured in accordance with another embodiment of the invention.

FIG. 11 is an enlarged isometric view of a portion of the second track section 114*b* illustrating a track aperture 1160. In the illustrated embodiment, the track aperture 1160 is produced by forming a first notch 1128*a* in the first flange 219*a* of the first side portion 210*a*, and a second notch 1128*b* in the second flange 219*b* of the second side portion 210*b*. The notches 1128 can be formed in the respective side portions 210 prior to clinching or otherwise joining the side portions 210 together.

The aperture 1160 may be necessary or desirable to accommodate various types of mechanisms which can be operably coupled to the second track section 114*b*. The third track section 114*c* can also include an aperture that is at least generally similar in structure and function to the aperture 1160. For example, in one embodiment, the aperture 1160 can be configured to accommodate a door anti-drift mechanism (not shown) that may be used to hold a door guide member (e.g., the interlocking guide member 250 described above with reference to FIG. 2) in a desired position and keep it from drifting. In other embodiments, however, the track aperture 1160 and/or other track apertures having different or similar shapes can be formed for different purposes.

Figure 12:
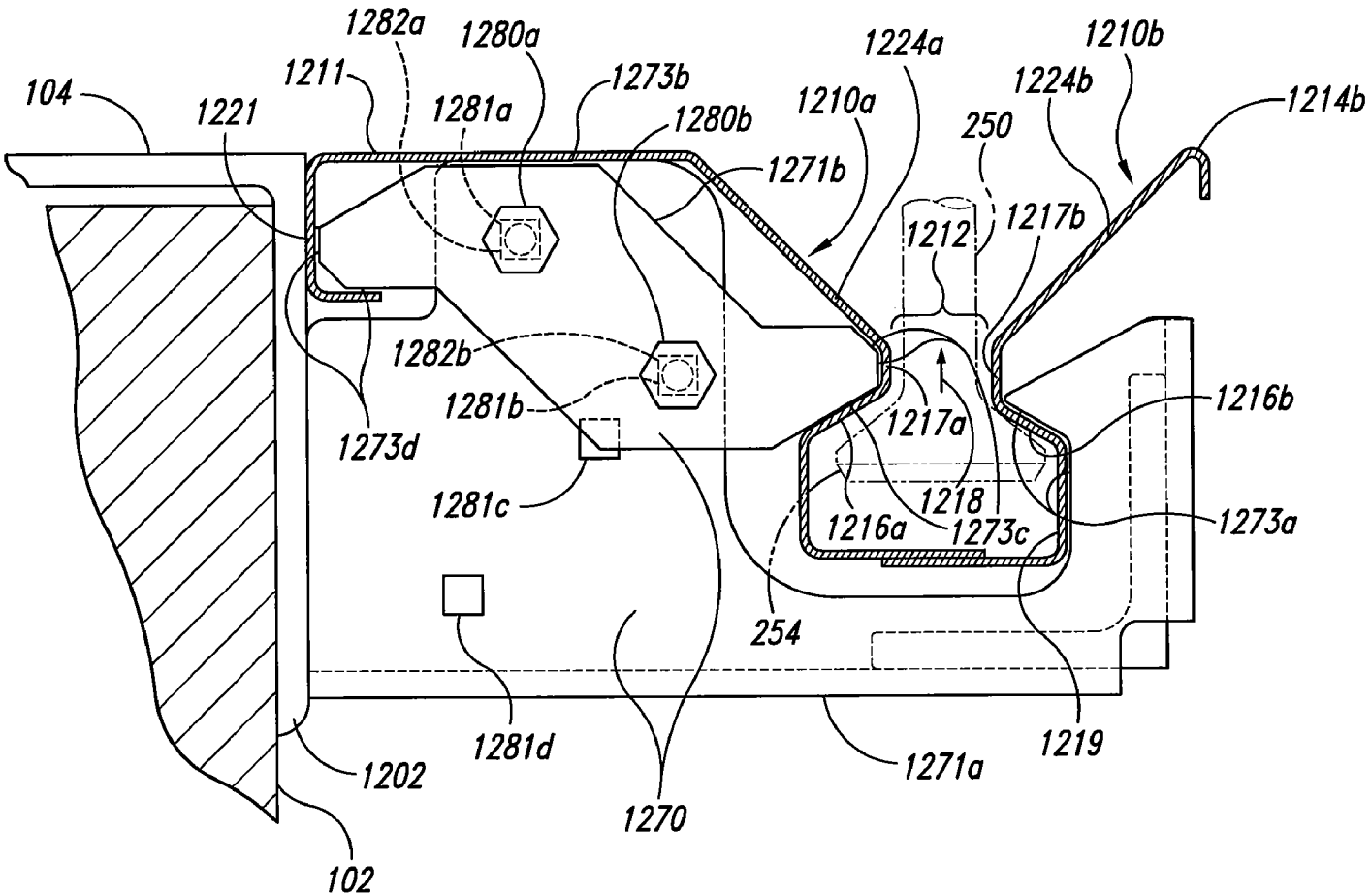
FIG. 12 is a cross-sectional end view of a track section and track bracket configured in accordance with an embodiment of the invention.

FIG. 12 is a cross-sectional end view of a track section 1214*b* fixedly attached to the wall 102 with a track bracket 1270 configured in accordance with an embodiment of the invention. In the illustrated embodiment, the track section 1214*b* is at least generally similar in structure and function to the second track section 114*b* described above with reference to, e.g., FIG. 2. Accordingly, the track section 1214*b* can be used with both the interlocking guide assemblies 124 and the releasable guide assemblies 126 described above with reference to, e.g., FIGS. 2 and 3, respectively. For example, the track section 1214*b* can include a first side portion 1210*a* spaced apart from a second side portion 1210*b* to define a channel or gap region 1212 therebetween. The first side portion 1210*a* can include a seal surface 1211, a first guide surface 1224*a*, and a first retention surface 1216*a*. The second side portion 1210*b* can include an opposing second guide surface 1224*b* and a second retention surface 1216*b*. In the illustrated embodiment, the first retention surface 1216*a* is slightly offset from the second retention surface 1216*b* in direction 1218. This offset can allow the head portion 254 of the interlocking guide member 250 (shown in phantom line) to rub and/or roll against one of the two retention surfaces (e.g., the second retention surface 1216*b*) without rubbing or dragging against the other retention surface and resulting in premature wear of the track section 1214*b* and/or the interlocking guide member 250. In other embodiments, however, the first and second retention surfaces 1216 can be aligned or not offset, or have other offsets.

The first side portion 1210*a* also includes a first transition surface 1217*a* extending between the first guide surface 1224*a* and the first retention surface 1216*a*, and the second side portion 1210*b* includes a second transition surface 1217*b* extending between the second guide surface 1224*b* and the second retention surface 1216*b*. The first and second transition surfaces 1217 can be flat, or at least generally flat. Moreover, in the illustrated embodiment the second transition surface 1217*b* can be wider than the first transition surface 1217*a* to accommodate the offset between the two retention surfaces 1216. In other embodiments, however, the first and second transition surfaces 1217 can have other dimensions, other shapes, and/or be omitted. For example, in other embodiments the first and second transition surfaces can have equal or at least approximately equal widths.

In one aspect of this embodiment, the track bracket 1270 includes a first fitting 1271*a* joined to a second fitting 1271*b*. The first fitting 1271*a* can include a first edge region 1273*a* that has the same shape, or at least approximately the same shape, as a portion of the second side portion 1210*b*. For example, in the illustrated embodiment the first edge region 1273*a* has the same shape, or at least approximately the same shape, as the second side portion 1210*b* in the region of the second retention surface 1216*b* and an adjacent track surface 1219. The first fitting 1271*a* can also include a second edge region 1273*b* that is shaped to fit against the first side portion 1210*a* adjacent to the seal surface 1211. The second fitting 1271*b* can include a third edge region 1273*c* toward one end of the second fitting 1271*b*, and a fourth edge region 1273*d* toward the other end of the second fitting 1271*b*. The third and fourth edge regions 1273*c* and 1273*d* can have the same shapes, or at least approximately the same shapes, as adjacent portions of the first side portion 1210*a* so that they fit into these portions of the first side portion 1210*a* as shown in FIG. 12. For example, in the illustrated embodiment the third edge region 1273*c* has the same contour or shape, or at least approximately the same shape, as the first side portion 1210*a* in the region of the first guide surface 1224*a*, the first transition surface 1217*a*, and the first retention surface 1216*a*. The fourth edge region 1273*d* has the same shape, or at least approximately the same shape, as the first side portion 1210*a* in the region of the seal surface 1211 and an adjacent track surface 1221.

During installation of the track section 1214*b*, the first fitting 1271*a* can be fit against the second side portion 1210*b* and the second fitting 1271*b* can be fit against the first side portion 1210*a*, as shown in FIG. 12. The first and second fittings 1271 can then be joined together with one or more fasteners 1280 (identified individually as a first fastener 1280*a* and a second fastener 1280*b*) which extend through corresponding apertures 1281*a, b* and 1282*a, b* in the second fitting 1271*b* and the first fitting 1271*a*, respectively. The fasteners 1280 can include suitable bolt/nut combinations (e.g., carriage bolt/nut combinations), rivets, screws, etc., as well as other suitable fastening methods known in the art such as clinching, adhesives, welding, etc. In addition to the apertures 1281*a,b*, the first fitting 1271*a* can also include a third aperture 1281*c* and a fourth aperture 1281*d*. In one embodiment, the second fitting 1271*b* can be temporarily coupled to the first fitting 1271*a* via the third and fourth apertures 1282*c, d* so that the first and second fittings 1271*a, b* can be shipped from the factory or other manufacturing facility to a warehouse or worksite as a matched set.

The first and second fittings 1271 of the track bracket 1270 can be formed from a suitable metal, such as mild steel (e.g., 16 gauge ASTM A-653, G90) that can be easily formed and welded. In other embodiments, the fittings 1271 can be made from other suitable materials including other metallic materials (e.g., galvanized steel, aluminum, etc.) and/or non-metallic materials (plastics, composites, etc.).

Figure 13:
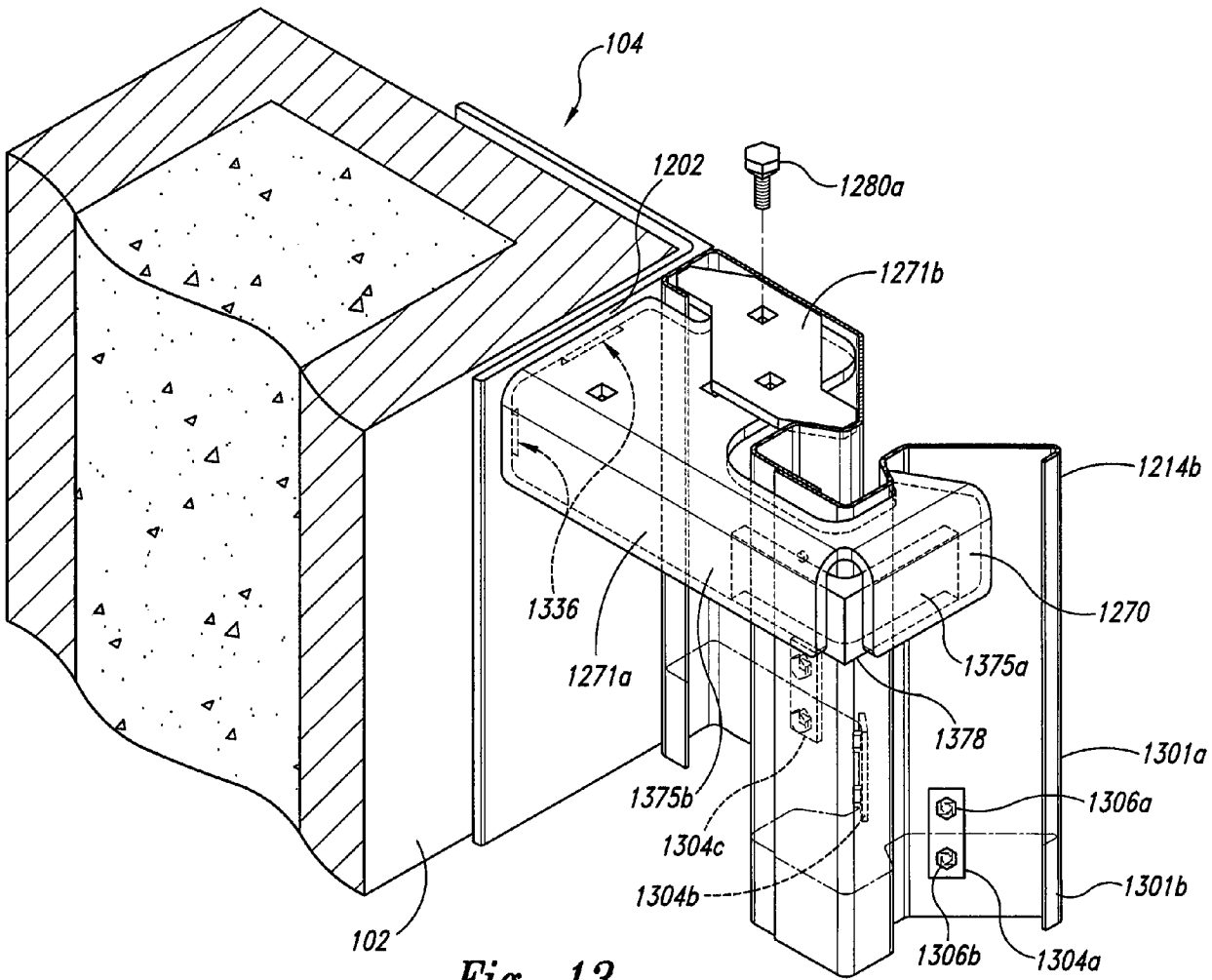
FIG. 13 is an isometric view of the track section and track bracket of FIG. 12.

FIG. 13 is an isometric view of the track section 1214*b* and the bracket 1270 discussed above with reference to FIG. 12. As this view illustrates, the track section 1214*b* of the illustrated embodiment can be assembled from a first piece of track section 1301*a* and a second piece of track section 1301*b*, which are joined together by a plurality of splices 1304 (Identified individually as splices 1304*a-c*). The splices 1304 can be joined to adjacent ends of the track pieces 1301 by one or more suitable fasteners 1306 (e.g., bolts, screws, rivets, etc.). In other embodiments, the adjacent track sections 1301 can be joined together by welding, bonding, clinching, etc.

In the illustrated embodiment, the bracket 1270 includes an angle brace 1378 that is welded or otherwise suitably attached (e.g., with rivets) to a first flange 1375*a* and an adjacent second flange 1375*b* of the first bracket fitting 1271*a*. In other embodiments where, for example, additional strength or stiffness is not necessary, the brace 1378 can be omitted.

In the illustrated embodiment, the wall 102 includes an edge member 1202 (e.g., an angle formed from mild steel) forming a corner between the wall 102 and the door opening 104. To install the track section 1214*b* on the wall 102, the first fitting 1271*a* can be attached to the edge member 1202 in an appropriate location with a suitable weld 1336 (e.g., a fillet weld) or other suitable fastening method. The track section 1214*b* can then be positioned in the first fitting 1271*a*, and the second fitting 1271*b* can be positioned against the first side portion 1210*a* of the track section 1214*b* as shown in FIG. 13. The second fitting 1271*b* can then be attached to the first fitting 1271*a* as explained above with reference to FIG. 12 to hold the track section 1214*b* in position. In other embodiments, the bracket 1270 can be fixedly attached to the wall 102 by other suitable methods such as fasteners, mounting brackets, and other methods known in the art.

Figure 14:
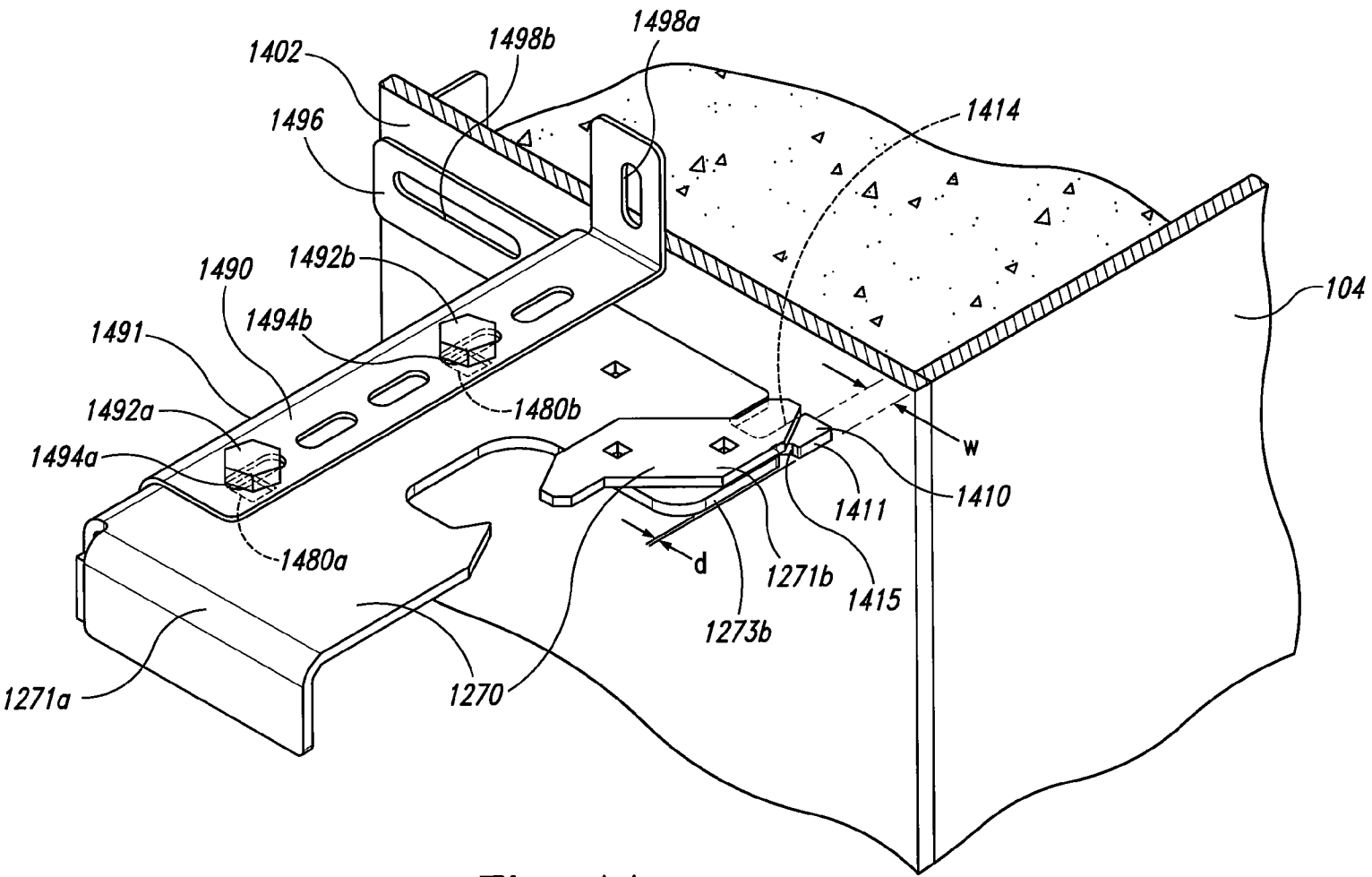
FIG. 14 is an isometric view of a track bracket mounting arrangement configured in accordance with an embodiment of the invention.

FIG. 14 is an isometric view illustrating another method of attaching the track bracket 1270 to a wall 1402. In the illustrated embodiment, the wall 1402 includes a wood exterior, and the track bracket 1270 is attached to the wall 1402 by a mounting bracket 1490. The mounting bracket 1490 includes a body 1491 that extends outwardly from a base 1496. The base 1496 can include a plurality of mounting holes 1498 (e.g., a first elongated hole 1498*a* and a second elongated hole 1498*b*) through which wood screws (not shown) or other suitable fasteners can be installed to attach the mounting bracket 1490 to the wall 1402. The body 1491 of the mounting bracket 1490 can include a plurality of apertures 1494*a, b* adjacent to corresponding apertures 1480*a, b* in the first fitting 1271*a* of the track bracket 1270. In the illustrated embodiment, the apertures 1494 in the mounting bracket 1490 can be elongated to allow for some adjustment of the position of the track bracket 1270 relative to the wall 1402. Suitable fasteners 1492*a, b* (e.g., nut/bolt combinations, screws, rivets, etc.) can be installed through the apertures 1494 and 1480 to attach the track bracket 1270 to the mounting bracket 1490. As the foregoing illustrates, there are a number of different ways in which the track bracket 1270 can be attached to various types of walls for use with the overhead door track assemblies described herein. Accordingly, the present disclosure is not limited to the particular embodiments described above.

In another aspect of this embodiment, the first fitting 1271*a* can include a locating feature, such as a tab 1410, to facilitate proper positioning of the bracket 1270 on the wall 1402. In the illustrated embodiment, the tab 1410 includes a first surface 1411 offset from the second edge region 1273*b* of the first fitting 1271*a* by an offset distance d. As described in greater detail below, the offset distance d can be equal to, or at least approximately equal to the gauge or thickness of the track section material that will subsequently be mounted to the bracket 1270. For example, if the track section (e.g., the track section 1214*b* of FIG. 12) material is nominally 0.050 inch thick, the offset distance d can be 0.050 inch, or about 0.050 inch.

During installation of the first fitting 1271*a*, the first surface 1411 can be aligned with the door jamb or opening 104 and held in position while the first fitting 1271*a* is attached to the wall 1402 as described above. Because of the offset distance d, this positioning will ensure that the second edge region 1273*b* is set back from the door jamb by a distance that is equal to, or at least approximately equal to, the track material thickness. As a result, the outer surface of the track (e.g., the seal surface 1211 of FIG. 12) that is subsequently installed in the bracket 1270 will be flush, or at least generally flush with the door opening 104.

In another aspect of this embodiment, the tab 1410 includes a second surface 1414 opposite to the first surface 1411. The second surface 1414 is offset a preset distance w (e.g., from about 0.25 inch to about 1 inch, or about 0.50 inch) from the first surface 1411. The offset distance w allows a tape measure or similar measurement device (not shown) to be engaged with the second surface 1414 and extended across the door opening 104 for proper positioning of the corresponding track bracket (not shown) on the opposite side of the door opening 104. In this regard, the second surface 1414 provides a convenient edge that is suitable for engaging the tip of the tape measure or other suitable measuring device. Moreover, because of the known offset distance w between the first surface 1411 and the second surface 1414, the proper bracket-to-bracket spacing can be easily established across the door opening 104 before installation of the opposite track bracket.

After the first fitting 1271*a* has been installed, the tab 1410 can be broken off of the first fitting 1271*a* by grasping the tab 1410 with pliers or a similar device and twisting. An undercut region 1415 facilitates removal of the tab 1410 by this method. Removal of the tab 1410 enables installation of the corresponding track section.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A track for use with an overhead door, the track comprising:

a first side portion formed from a first piece of material, the first side portion having a first guide surface and a first retention surface;

a second side portion formed from a second piece of material, the second side portion having a second guide surface and a second retention surface;

wherein the first side portion further includes a first flange, wherein the second side portion further includes a second flange that overlaps the first flange, and wherein the first flange is attached to the second flange to join the first side portion to the second side portion and define a gap region therebetween;

wherein the first and second guide surfaces diverge from the gap region toward a first direction; and wherein the first and second retention surfaces diverge from the gap region toward a second direction, opposite to the first direction.

2. The track of claim 1, further comprising a plurality of clinched connections joining the first flange to the second flange.

3. The track of claim 1 wherein the first and second guide surfaces form a first V groove extending outwardly from the gap region in the first direction, and wherein the first and second retention surfaces form a second V groove extending outwardly from the gap region in the second direction.

4. The track of claim 1 wherein the first guide surface is disposed at an angle of from about 60 degrees to about 120 degrees relative to the second guide surface, and wherein the first retention surface is disposed at an angle of from about 40 degrees to about 180 degrees relative to the second retention surface.

5. The track of claim 1 wherein the first side portion further includes a first corner portion positioned between the first guide surface and the first retention surface, wherein the second side portion further includes a second corner portion positioned between the second guide surface and the second retention surface, and wherein the first and second corner portions define the gap region.

6. The track of claim 1 wherein the gap region between the first and second side portions is configured to movably receive an overhead door guide member.

7. The track of claim 1 wherein the first side portion is formed from a first piece of sheet metal and the second side portion is formed from a second piece of sheet metal.

8. A track assembly for use with an overhead door, the overhead door having at least one guide member extending outwardly therefrom along a longitudinal axis, the track assembly comprising:

a first track section, the first track section including:

a first side portion formed from a first piece of material, the first side portion having a first guide surface positioned at an oblique angle to the longitudinal axis of the guide member; and a second side portion formed from a second piece of material, the second side portion having a second guide surface, wherein the second guide surface is at least approximately parallel to the longitudinal axis of the guide member, and wherein the second guide surface is spaced apart from the first guide surface to form a first V-groove configured to movably receive the guide member; and a second track section operably coupled to the first track section, the second track section including:

a third side portion, the third side portion having a third guide surface positioned at an oblique angle to the longitudinal axis of the guide member; and a fourth side portion, the fourth side portion having a fourth guide surface positioned at an oblique angle to the longitudinal axis of the guide member, wherein the fourth guide surface is spaced apart from the third guide surface to form a second V-groove configured to movably receive the guide member.

9. The track assembly of claim 8 wherein the first side portion and the third side portion are formed from the same first piece of material.

10. The track assembly of claim 8 wherein the first side portion and the third side portion are formed from the same first piece of material, and wherein the fourth side portion is formed from a third piece of material.

11. The track assembly of claim 8 wherein the first side portion further includes a first flange, wherein the second side portion further includes a second flange that overlaps a first portion of the first flange, and wherein the fourth side portion further includes a third flange that overlaps a second portion of the first flange.

12. The track assembly of claim 11, further comprising a first plurality of fasteners extending though the overlapping portions of the first and second flanges, and a second plurality of fasteners extending through the overlapping portions of the first and fourth flanges.

13. The track assembly of claim 11, further comprising a first plurality of clinched connections extending though the overlapping portions of the first and second flanges, and a second plurality of clinched connections extending through the overlapping portions of the first and fourth flanges.

14. The track assembly of claim 8, further comprising a third track section operably coupled to the second track section, the third track section including:

a fifth side portion formed from a third piece of material, the fifth side portion having a fifth guide surface, wherein the fifth guide surface is at least approximately parallel to the longitudinal axis of the guide member; and a sixth side portion formed from a fourth piece of material, the sixth side portion having a sixth guide surface, wherein the sixth guide surface is at least approximately parallel to the fifth guide surface, and wherein the sixth guide surface is spaced apart from the fifth guide surface to movably receive the overhead door guide member.

15. The track assembly of claim 8 wherein the third guide surface is at least approximately parallel to the first guide surface.

16. The track assembly of claim 8 wherein the first V-groove defines a first angle and the second V-groove defines a second angle, larger than the first angle.

17. The track assembly of claim 8 wherein the first side portion is spaced apart from the second side portion to define a channel region therebetween, wherein the first and second guide surfaces diverge from the channel region in a first direction, wherein the first side portion further includes a first retention surface positioned at an oblique angle to the longitudinal axis of the guide member, wherein the second side portion further includes a second retention surface positioned at an oblique angle to the longitudinal axis of the guide member, and wherein the first and second retention surfaces diverge from the channel region in a second direction, opposite to the first direction.

18. A track assembly for use with an overhead door, the track assembly comprising:

a track, the track including:

a first side portion having a first guide surface; and a second side portion having a second guide surface spaced apart from the first guide surface; and a track bracket, the track bracket including:

a first fitting having a first edge region configured to receive the first side portion of the track; and a second fitting having a second edge region configured to receive the second side portion of the track, wherein at least a first portion of the first fitting overlaps a second portion of the second fitting, and wherein the overlapping portions of the first and second fittings are attached together to loin the second fitting to the first fitting.

19. The track assembly of claim 18 wherein the first fitting further includes a mounting flange configured to securely attach the track bracket to a building structure.

20. The track assembly of claim 18:

wherein the first side portion further includes a first retention surface;

wherein the second side portion further includes a second retention surface;

wherein the second side portion is spaced apart from the first side portion to define a channel region therebetween;

wherein the first and second guide surfaces diverge from the channel region toward a first direction; and wherein the first and second retention surfaces diverge from the channel region toward a second direction, opposite to the first direction.

21. The track assembly of claim 18:

wherein the first side portion is formed from a first piece of material and the second side portion is formed from a second piece of material;

wherein the second side portion is joined to the first side portion to define a channel region therebetween;

wherein the first and second guide surfaces diverge from the channel region toward a first direction;

wherein the first side portion further includes a first retention surface;

wherein the second side portion further includes a second retention surface; and wherein the first and second retention surfaces diverge from the channel region toward a second direction, opposite to the first direction.

22. A track assembly for use with an overhead door, the track assembly comprising:

a track, the track including:

a first side portion having a first guide surface; and a second side portion having a second guide surface spaced apart from the first guide surface; and a track bracket, the track bracket including:

a first fitting having a first edge region configured to receive the first side portion of the track; and a second fitting having a second edge region configured to receive the second side portion of the track, wherein the second fitting is fixedly joined to the first fitting, wherein at least a first portion of the first fitting overlaps a second portion of the second fitting, and wherein the track bracket further includes one or more clinched connections extending through the overlapping portions of the first and second fittings.

23. The track assembly of claim 22:

wherein the first side portion further includes a first flange;

wherein the second side portion further includes a second flange that overlaps the first flange; and wherein the track further includes a plurality of clinched connections extending through the first and second flanges.

24. A track for use with an overhead door, the track comprising:

a first side portion formed from a first piece of material, the first side portion having a first guide surface and a first retention surface;

a second side portion formed from a second piece of material, the second side portion having a second guide surface and a second retention surface;

wherein the first side portion is joined to the second side portion to define a gap region therebetween;

wherein the first and second guide surfaces diverge from the gap region toward a first direction;

wherein the first and second retention surfaces diverge from the gap region toward a second direction, opposite to the first direction, and wherein the first side portion further includes a first flange, wherein the second side portion further includes a second flange that overlaps the first flange, and wherein the track further includes a plurality of fasteners extending through the first and second flanges.

25. A track for use with an overhead door, the track comprising:

a first side portion formed from a first piece of material, the first side portion having a first guide surface and a first retention surface;

a second side portion formed from a second piece of material, the second side portion having a second guide surface and a second retention surface;

wherein the first side portion is joined to the second side portion to define a gap region therebetween;

wherein the first and second guide surfaces diverge from the gap region toward a first direction;

wherein the first and second retention surfaces diverge from the gap region toward a second direction, opposite to the first direction; and wherein the first side portion further includes a first flange, wherein the second side portion further includes a second flange that overlaps the first flange, and wherein the track further includes a plurality of clinched connections fixedly attaching the first flange to the second flange.

26. A track assembly for use with an overhead door, the track assembly comprising:

a track, the track including:

a first side portion having a first guide surface; and a second side portion having a second guide surface spaced apart from the first guide surface;

wherein the first side portion further includes a first flange;

wherein the second side portion further includes a second flange that overlaps the first flange; and wherein the track further includes a plurality of fasteners extending through the first and second flanges; and a track bracket, the track bracket including:

a first fitting having a first edge region configured to receive the first side portion of the track; and a second fitting having a second edge region configured to receive the second side portion of the track, wherein the second fitting is fixedly joined to the first fitting.

* * * * *

UNITED STATES PATENT AND TRADEMARK OFFICE

CERTIFICATE OF CORRECTION

PATENT NO. : 8,037,576 B2
APPLICATION NO. : 12/191140
DATED : October 18, 2011
INVENTOR(S) : Michael M. Meichtry It is certified that error appears in the above-identified patent and that said Letters Patent is hereby corrected as shown below:

In column 6, line 18, delete “assembling” and insert -- assembly --, therefor.

In column 6, line 27, delete “embodiment” and insert -- embodiment, --, therefor.

In column 18, line 28, in claim 18, delete “loin” and insert -- join --, therefor.

Signed and Sealed this
Thirty-first Day of January, 2012

David J. Kappos

David J. Kappos
*Director of the United States Patent and Trademark Office*